US011841010B2

(12) United States Patent
Taguchi

(10) Patent No.: US 11,841,010 B2
(45) Date of Patent: Dec. 12, 2023

(54) VARIABLE DISPLACEMENT COMPRESSOR

(71) Applicant: SANDEN AUTOMOTIVE COMPONENTS CORPORATION, Isesaki (JP)

(72) Inventor: Yukihiko Taguchi, Isesaki (JP)

(73) Assignee: SANDEN CORPORATION, Isesaki (JP)

( * ) Notice: Subject to any disclaimer, the term of this patent is extended or adjusted under 35 U.S.C. 154(b) by 225 days.

(21) Appl. No.: 17/438,794

(22) PCT Filed: Mar. 16, 2020

(86) PCT No.: PCT/JP2020/011350
§ 371 (c)(1),
(2) Date: Sep. 13, 2021

(87) PCT Pub. No.: WO2020/189604
PCT Pub. Date: Sep. 24, 2020

(65) Prior Publication Data

US 2022/0145869 A1 May 12, 2022

(30) Foreign Application Priority Data

Mar. 20, 2019 (JP) ..... 2019-052134

(51) Int. Cl.
*F04B 27/18* (2006.01)
*F04B 27/08* (2006.01)

(52) U.S. Cl.
CPC ..... *F04B 27/18* (2013.01); *F04B 27/0873* (2013.01); *F04B 27/1804* (2013.01);
(Continued)

(58) Field of Classification Search
CPC .. F04B 27/0873; F04B 27/18; F04B 27/1804; F04B 2027/1813; F04B 2027/1827; F04B 2027/1831; F04B 2027/185; F16K 15/02
See application file for complete search history.

(56) References Cited

U.S. PATENT DOCUMENTS 284,452 A * 9/1883 MacKinney ..... F16K 15/02 137/455
5,100,299 A * 3/1992 Vadasz F. ..... F16K 15/02 137/533.17

(Continued)

FOREIGN PATENT DOCUMENTS

JP 2010-106677 A 5/2010
JP 2016-108960 A 6/2016

(Continued)

OTHER PUBLICATIONS

Japan Patent Office, International Search Report issued in International Application No. PCT/JP2020/011350, dated May 26, 2020.

*Primary Examiner* — Devon C Kramer
*Assistant Examiner* — Joseph S. Herrmann
(74) *Attorney, Agent, or Firm* — Baker Botts L.L.P.

(57) ABSTRACT

Provided is a variable displacement compressor that is directed to cost reduction and productivity enhancement of a second control valve that adjusts an opening degree of a discharge passage for discharging a refrigerant in a controlled pressure chamber to a suction chamber. The variable displacement compressor includes the second control valve (400) configured to decrease an opening degree of the discharge passage to a minimum value when a first end surface (421*a*) of a valve body (420) accommodated in a valve chamber (410) comes into contact with a first end wall surface (411) of the valve chamber (410) to close a second port (432) and a third port (433), and configured to increase the opening degree of the discharge passage to a maximum value when the first end surface (421*a*) of the valve body (420) separates from the first end wall surface (411) of the valve chamber (410) to open the second port (432) and the third port (433). The valve body (420) is supported movably in a direction perpendicular to the first end wall surface (411) without contact with a peripheral wall surface (413) of the (Continued)

valve chamber (410), by a guide shaft portion (415*a*) being slidably inserted into a receiving portion (423) formed at a radially center portion of the valve body (420).

20 Claims, 11 Drawing Sheets

(52) U.S. Cl.
CPC . *F04B 2027/185* (2013.01); *F04B 2027/1813* (2013.01); *F04B 2027/1827* (2013.01); *F04B 2027/1831* (2013.01)

(56) References Cited

U.S. PATENT DOCUMENTS

| | | | | |
|---|---|---|---|---|
| 8,714,938 | B2 * | 5/2014 | Okuda | F04B 27/1804 417/269 |
| 2010/0104454 | A1 * | 4/2010 | Ota | F04B 27/1804 417/269 |
| 2017/0356439 | A1 * | 12/2017 | Taguchi | F04B 27/1804 |
| 2017/0363074 | A1 * | 12/2017 | Taguchi | F04B 27/0804 |

FOREIGN PATENT DOCUMENTS

| | | | |
|---|---|---|---|
| WO | 2018/123633 | A1 | 7/2018 |
| WO | 2018/186034 | A1 | 10/2018 |
| WO | 2019/139132 | A1 | 7/2019 |

* cited by examiner

VARIABLE DISPLACEMENT COMPRESSOR

CROSS-REFERENCE TO RELATED APPLICATIONS

This application is a U.S. National Stage Patent Application under 37 U.S.C. § 371 of International Patent Application No. PCT/JP2020/011350, filed on Mar. 16, 2020, which claims the benefit of Japanese Patent Application No. JP 2019-052134, filed on Mar. 20, 2019, the disclosures of each of which are incorporated herein by reference in their entirety.

TECHNICAL FIELD

The present invention relates to a variable displacement compressor which is configured to vary a discharge volume by supplying a refrigerant in a discharge chamber to a controlled pressure chamber and also discharging a refrigerant in the controlled pressure chamber to a suction chamber, to thereby adjust the pressure in the controlled pressure chamber.

BACKGROUND ART

A variable displacement compressor of this type is disclosed in Patent Document 1. This variable displacement compressor includes first and second control valves. The first control valve adjusts the opening degree of a supply passage for supplying the refrigerant in the discharge chamber to a crank chamber. The second control valve adjusts the opening degree of a discharge passage for discharging a refrigerant in the crank chamber to the suction chamber. The second control valve includes a back pressure chamber, a valve chamber, and a spool. The back pressure chamber communicates with a region of the supply passage on a downstream side of the first control valve. The valve chamber is partitioned from the back pressure chamber by a partition member, to constitute a part of the discharge passage. Also, the valve chamber has a valve hole in a wall surface opposing the back pressure chamber.

The valve hole communicates with the crank chamber. The spool includes a pressure receiving portion that is provided in the back pressure chamber, a valve portion that is provided in the valve chamber, and a shaft portion that is inserted into a through hole formed in the partition member.

The second control valve has the following configuration. That is, when the first control valve opens the supply passage and then higher pressure acts on the pressure receiving portion, the spool moves toward the valve hole and the valve portion closes the valve hole. With this operation, the discharge passage is adjusted to a minimum opening degree. In addition, when the first control valve closes the supply passage and then lower pressure acts on the pressure receiving portion, the spool moves away from the valve hole and the valve portion opens the valve hole. With this operation, the discharge passage is adjusted to a maximum opening degree.

REFERENCE DOCUMENT LIST

Patent Document

Patent Document 1: JP 2016-108960 A

SUMMARY OF THE INVENTION

Problem to be Solved by the Invention

In the above-described conventional second control valve, the partition member, an integrated structure of the valve portion and shaft portion of the spool, and the pressure receiving portion of the spool are separately formed. Those portions are assembled such that the pressure receiving portion comes into contact with the partition member at the same time when the valve portion closes the valve hole. Accordingly, the second control valve requires a relatively complicated configuration and thus necessarily requires many assembly steps and management items. This leads to cost and productivity problems.

In view of the above, an object of the present invention is to reduce the cost of, and improve the productivity of, a second control valve in a variable displacement compressor, which adjusts the opening degree of a discharge passage for discharging a refrigerant in a controlled pressure chamber to a suction chamber.

Means for Solving the Problem

According to an aspect of the present invention, provided is a variable displacement compressor which is configured to vary a discharge volume by supplying a refrigerant in a discharge chamber to a controlled pressure chamber through a supply passage and also discharging a refrigerant in the controlled pressure chamber to a suction chamber through a discharge passage so as to adjust a pressure in the controlled pressure chamber. The variable displacement compressor includes: a first control valve configured to adjust an opening degree of the supply passage; a check valve that is provided in the supply passage at a position closer to the controlled pressure chamber than the first control valve and is configured to block a refrigerant flowing from the controlled pressure chamber toward the first control valve; a throttle passage for discharging a refrigerant in a region of the supply passage between the first control valve and the check valve to the suction chamber; and a second control valve configured to adjust an opening degree of the discharge passage. The second control valve includes: a valve chamber having a first end wall surface, a second end wall surface that faces the first end wall surface, a peripheral wall surface that extends between the first end wall surface and the second end wall surface, and an extended surface that extends radially inward from an intermediate portion in an extending direction of the peripheral wall surface; and a valve body having a first end surface and a second end surface that opposes the first end surface and being accommodated in the valve chamber so as to move inside the valve chamber based on a differential pressure between the region and the controlled pressure chamber. In the valve body, a first port that communicates with the region is open to the second end wall surface or to a portion of the peripheral wall surface closer to the second end wall surface than the extended surface, and a second port that communicates with the controlled pressure chamber and also constitutes a part of the discharge passage and a third port that communicates with the suction chamber and also constitutes a part of the discharge passage are open to the first end wall surface. The second control valve is configured such that when the first control valve opens the supply passage and then a pressure in the region becomes higher than a pressure in the controlled pressure chamber, the first end surface of the valve body comes into contact with the first end wall surface of the valve chamber, to close the second port and the third port, with which the discharge passage is adjusted to a minimum opening degree, whereas when the first control valve closes the supply passage and then the pressure in the region becomes lower than the pressure in the controlled pressure chamber, the first end surface of the valve body separates from the first end wall surface of the valve chamber, to open the second port and the third port, with which the discharge passage is adjusted to a maximum opening degree and also the second end surface of the valve body comes into contact with the extended surface, to partition the inside of the valve chamber into a first space to which the first port is open and a second space to which the second port and the third port are open, or the second end surface of the valve body comes into contact with the second end wall surface of the valve chamber, to minimize a gap between the extended surface and an opposite surface of the valve body that faces the extended surface. Moreover, the valve chamber includes a valve body support portion that supports a radially center portion of the valve body so that the valve body is movable in a direction perpendicular to the first end wall surface without contact with the peripheral wall surface.

Effects of the Invention

The second control valve of the variable displacement compressor has much simpler configuration than the above-described conventional second control valve. This ensures the cost reduction and productivity enhancement of the second control valve. Moreover, the valve body of the second control valve is supported at its radially center portion so as to be movable in the direction perpendicular to the first end wall surface of the valve chamber without contact with the peripheral wall surface of the valve chamber. This ensures stable and smooth movement of the valve body in the valve chamber.

BRIEF DESCRIPTION OF THE DRAWINGS

FIGS. 5A and 5B are sectional views of a second control valve of the variable displacement compressor, in which FIG. 5A shows a state of the second control valve when the first control valve is opened and FIG. 5B shows a state of the second control valve when the first control valve is closed.

FIGS. 8A and 8B are sectional views of a check valve of the variable displacement compressor, in which FIG. 8A shows a state of the check valve when the first control valve is opened and FIG. 8B shows a state of the check valve when the first control valve is closed.

MODE FOR CARRYING OUT THE INVENTION

Embodiments of the present invention will be described below with reference to the accompanying drawings.

Figure 1:
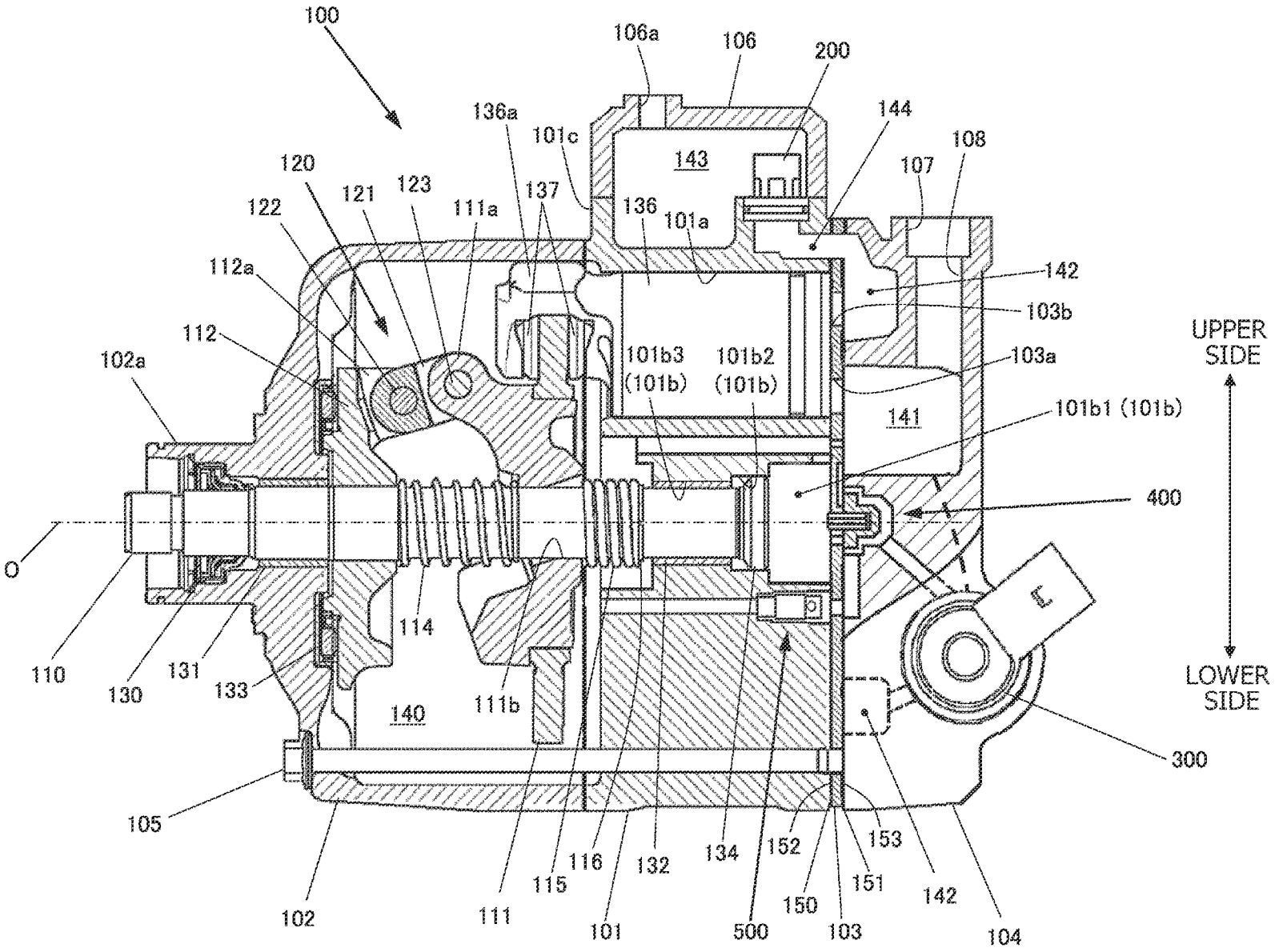
FIG. 1 is a sectional view of a variable displacement compressor according to Embodiment 1 of the present invention.

FIG. 1 is a sectional view of a variable displacement compressor according to an embodiment of the present invention. The variable displacement compressor of this embodiment is configured as a clutchless compressor that is primarily used for vehicular air conditioner systems. In FIG. 1, the upper and lower sides are defined by the direction of gravity.

As shown in FIG. 1, a variable displacement compressor 100 includes a cylinder block 101, a front housing 102, and a cylinder head 104. The cylinder block 101 has a plurality of cylinder bores 101*a* that are annularly arranged. The front housing 102 is provided at one end of the cylinder block 101. The cylinder head 104 is provided at the other end of the cylinder block 101 via a valve plate 103.

The front housing 102, a center gasket (not shown), the cylinder block 101, a cylinder gasket 152, a suction valve forming plate 150, the valve plate 103, a discharge valve forming plate 151, a head gasket 153, and the cylinder head 104 are arranged in this order and fastened together by a plurality of through bolts 105, to constitute a compressor housing. Moreover, the cylinder block 101 and the front housing 102 constitute a crank chamber 140. A laterally extending drive shaft 110 passes through the crank chamber 140.

The drive shaft 110 is provided with a swash plate 111 at its axially intermediate portion. The swash plate 111 is connected to a rotor 112 fixed to the drive shaft 110, via a linkage mechanism 120 so as to rotate together with the drive shaft 110. Moreover, the swash plate 111 is configured to have variable angle (inclined angle of the swash plate 111) relative to a plane perpendicular to an axial line (center line) 0 of the drive shaft 110.

The linkage mechanism 120 includes a first arm 112*a*, a second arm 111*a*, and a linkage arm 121. The first arm 112*a* protrudes from the rotor 112. The second arm 111*a* protrudes from the swash plate 111. The linkage arm 121 has one end rotatably connected to the first arm 112*a* via a first connection pin 122 and has the other end rotatably connected to the second arm 111*a* via a second connection pin 123.

The swash plate 111 has a through hole 111*b* to which the drive shaft 110 is inserted. The through hole 111*b* has a shape that allows the swash plate 111 to incline within a range between a maximum inclination angle and a minimum inclination angle. The through hole 111*b* has a minimum inclination angle restriction portion. Assuming that the minimum inclination angle (=0°) is the inclination angle of the swash plate 111 at which the swash plate 111 is perpendicular to the drive shaft 110, when the inclination angle of the swash plate 111 is almost 0°, the minimum inclination angle restriction portion of the through hole 111*b* comes into contact with the drive shaft 110 to restrict the swash plate 111 from inclining any more. Moreover, when the inclination angle of the swash plate 111 reaches the maximum inclination angle, the swash plate 111 comes into contact with the rotor 112 and thus is restricted from inclining any more.

The drive shaft 110 has attached thereto an inclination angle decreasing spring 114 and an inclination angle increasing spring 115. The inclination angle decreasing spring 114 biases the swash plate 111 toward a direction of decreasing the inclination angle of the swash plate 111. The inclination angle increasing spring 115 biases the swash plate 111 toward a direction of increasing the inclination angle of the swash plate 111. The inclination angle decreasing spring 114 is provided between the swash plate 111 and the rotor 112. The inclination angle increasing spring 115 is attached between the swash plate 111 and a spring support member 116 fixed to the drive shaft 110.

According to the setting of the swash plate 111, when the swash plate 111 is at the minimum inclination angle, the inclination angle increasing spring 115 exerts larger biasing force than the biasing force of the inclination angle decreasing spring 114. Moreover, when the drive shaft 110 is not rotated, the swash plate 111 is positioned at the inclination angle at which the biasing force of the inclination angle decreasing spring 114 balances the biasing force of the inclination angle increasing spring 115.

The drive shaft 110 has one end (left end in FIG. 1) passing through a protrusion 102*a* of the front housing 102 which partially protrudes outward, and extending to the outside of the front housing 102. The one end of the drive shaft 110 is connected to a power transmission device (not shown). The inside of the crank chamber 140 is sealed from an external space by a shaft sealing device 130 that is provided at the protrusion 102*a*.

The drive shaft 110 has the other end (right end in FIG. 1) inserted into a center bore 101*b* that is formed in the cylinder block 101. The center bore 101*b* passes through the cylinder block 101 at substantially the center of the plurality of cylinder bores 101*a*. The center bore 101*b* has a large-diameter bore portion 101*b*1, a medium-diameter bore portion 101*b*2, and a small-diameter bore portion 101*b*3, which are arranged from the cylinder head 104 side toward the crank chamber 140 side. The large-diameter bore portion 101*b*1 is open to an end surface of the cylinder block 101 on the cylinder head 104 side. The medium-diameter bore portion 101*b*2 has a smaller diameter than the large-diameter bore portion 101*b*1. The small-diameter bore portion 101*b*3 has a smaller diameter than the medium-diameter bore portion 101*b*2.

A connected structure of the drive shaft 110 and the rotor 112 fixed to the drive shaft 110, is supported by a first bearing 131 and a second bearing 132 in a radial direction, and is supported by a third bearing 133 and a thrust receiving member 134 in a thrust direction. The drive shaft 110 is configured to rotate in synchronization with the rotation of the power transmission device that rotates on power transmitted thereto from an external drive source.

In this embodiment, the first bearing 131 is attached to the inside of the shaft sealing device 130 at the protrusion 102*a* of the front housing 102, and the second bearing 132 is attached to the small-diameter bore portion 101*b*3 of the center bore 101*b* in the cylinder block 101. In addition, the third bearing 133 is provided between the rotor 112 and an inner surface of the front housing 102, and the thrust receiving member 134 is attached to the medium-diameter bore portion 101*b*2 of the center bore 101*b* in the cylinder block 101.

Each cylinder bore 101*a* accommodates a piston 136. Each piston 136 has a protrusion 136*a* that protrudes into the crank chamber 140. The protrusion 136*a* has an accommodation space that accommodates an outer edge portion of the swash plate 111 and the vicinities thereof via a pair of shoes 137. With this structure, when the swash plate 111 rotates along with the rotation of the drive shaft 110, each piston 136 reciprocates inside a corresponding cylinder bore 101*a*.

The cylinder head 104 includes a suction chamber 141 and a discharge chamber 142. The suction chamber 141 is provided at substantially the center of the cylinder head 104. The discharge chamber 142 is formed annularly around the suction chamber 141. The suction chamber 141 and each cylinder bore 101*a* communicate with each other through a first through hole 103*a* that passes through, for example, the valve plate 103 and a suction valve (not shown) formed in the suction valve forming plate 150. The discharge chamber 142 and each cylinder bore 101*a* communicate with each other through a second through hole 103*b* that passes through, for example, the valve plate 103 and a discharge valve (not shown) formed in the discharge valve forming plate 151.

In an upper portion of the cylinder block 101, a muffler is provided. The muffler is formed by fastening a lid member 106 and a muffler forming wall 101*c* together by use of bolts (not shown) via a seal member (not shown). Here, the lid member 106 has a discharge port 106*a* and the muffler forming wall 101*c* is formed in the upper portion of the cylinder block 101.

A muffler space 143 surrounded by the lid member 106 and the muffler forming wall 101*c* communicates with the discharge chamber 142 through a communication passage 144. In the muffler space 143, a discharge check valve 200 is provided. The discharge check valve 200 is provided at a connection portion between the communication passage 144 and the muffler space 143. The discharge check valve 200 operates in response to a pressure difference between the communication passage 144 (upstream side) and the muffler space 143 (downstream side). The discharge check valve 200 is configured to close the communication passage 144 when the pressure difference is smaller than a predetermined value and to open the communication passage 144 when the pressure difference is larger than the predetermined value.

The communication passage 144, the discharge check valve 200, the muffler space 143, and the discharge port 106*a* constitute a discharge passage of the variable displacement compressor 100. The discharge chamber 142 is connected to a refrigerant circuit (high pressure side thereof) of the air conditioner system through the discharge passage.

The cylinder head 104 has a suction port 107 and a communication passage 108 through which the suction port 107 and the suction chamber 141 communicate with each other. The suction port 107 and the communication passage 108 constitute a suction passage of the variable displacement compressor 100. The suction chamber 141 is connected to the refrigerant circuit (low pressure side thereof) of the air conditioner system through the suction passage.

To the suction chamber 141, a refrigerant (low-pressure refrigerant) on the low pressure side of the refrigerant circuit of the air conditioner system is introduced (drawn in) through the suction passage. The refrigerant in the suction chamber 141 is drawn into a corresponding cylinder bore 101*a* through reciprocating movement of each piston 136 and is compressed and discharged to the discharge chamber 142. Then, the refrigerant (i.e., high-pressure refrigerant) having discharged to the discharge chamber 142 is introduced (discharged) to the high pressure side of the refrigerant circuit of the air conditioner system through the discharge passage. Moreover, the discharge check valve 200 prevents a refrigerant (refrigerant gas) from flowing back from the high pressure side of the refrigerant circuit of the air conditioner system to the discharge chamber 142.

Figure 2:
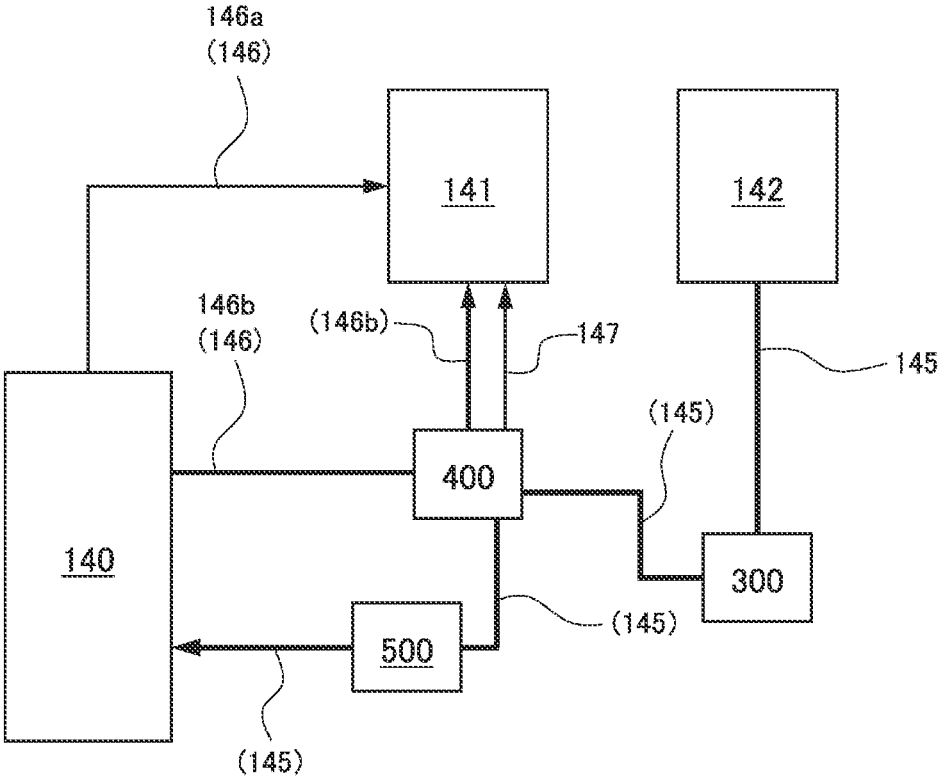
FIG. 2 schematically shows a supply passage, a discharge passage (first discharge passage and second discharge passage), and other components of the variable displacement compressor.

The variable displacement compressor 100 has a supply passage 145 and a discharge passage 146. The supply passage 145 is used to supply a refrigerant in the discharge chamber 142 to the crank chamber 140. The discharge passage 146 is used to discharge a refrigerant in the crank chamber 140 to the suction chamber 141. FIG. 2 schematically shows, for example, the supply passage 145 and the discharge passage 146 of the variable displacement compressor 100.

The supply passage 145 connects the discharge chamber 142 and the crank chamber 140, and has a first control valve 300 at some midpoint thereof. The first control valve 300 is configured to adjust the opening degree (passage cross-sectional area) of the supply passage 145, to thereby control a supply amount of refrigerant (high-pressure refrigerant) in the discharge chamber 142, which is to be supplied to the crank chamber 140.

The supply passage 145 has a check valve 500 at a position closer to the crank chamber 140 (downstream side) than the first control valve 300. The check valve 500 is configured to allow a refrigerant to flow from the first control valve 300 toward the crank chamber 140 as well as prevent a refrigerant from flowing (flowing back) from the crank chamber 140 toward the first control valve 300 side. In this embodiment, the check valve 500 is configured to open or close the supply passage 145 in synchronization with opening or closing of the first control valve 300. Specifically, the check valve 500 is configured to, when the first control valve 300 opens the supply passage 145, open the supply passage 145 to allow a refrigerant to flow from the first control valve 300 toward the crank chamber 140 and is configured to, when the first control valve 300 closes the supply passage 145, close the supply passage 145 to prevent the refrigerant from flowing from the crank chamber 140 toward the first control valve 300 side.

In this embodiment, the discharge passage 146 contains two passages. One of them is a passage (hereinafter referred to as "first discharge passage 146*a*") through which the crank chamber 140 and the suction chamber 141 communicate with each other all the time. The first discharge passage 146*a* has a throttle portion at some midpoint thereof. The other is a passage (hereinafter referred to as "second discharge passage 146*b*") which connects the crank chamber 140 and the suction chamber 141 and has a second control valve 400 at some midpoint thereof. The second discharge passage 146*b* is opened or closed by the second control valve 400. In this example, a passage cross-sectional area of each portion of the second discharge passage 146*b* is set to be larger than that of the throttle portion of the first discharge passage 146*a*.

In this embodiment, the supply passage 145 is formed so as to pass the second control valve 400. Specifically, a part of the second control valve 400 constitutes a part of a region of the supply passage 145 between the first control valve 300 and the check valve 500. Moreover, the second control valve 400 is configured to open or close the second discharge passage 146*b* in synchronization with opening or closing of the first control valve 300. Specifically, the second control valve 400 is configured to, when the first control valve 300 opens the supply passage 145, close the second discharge passage 146*b* and is configured to, when the first control valve 300 closes the supply passage 145, open the second discharge passage 146*b*. When the second discharge passage 146*b* is closed, the discharge passage 146 contains only the first discharge passage 146*a*. In this case, the discharge passage 146 has a minimum opening degree (passage cross-sectional area). In contrast, when the second control valve 400 opens the second discharge passage 146*b*, the discharge passage 146 contain the first discharge passage 146*a* and the second discharge passage 146*b*. In this case, the discharge passage 146 has a maximum opening degree (passage cross-sectional area).

As described above, in this embodiment, when the first control valve 300 closes the supply passage 145, the supply of a refrigerant (high-pressure refrigerant) in the discharge chamber 142 to the crank chamber 140 is stopped and the second control valve 400 opens the second discharge passage 146*b*. When the second control valve 400 opens the second discharge passage 146*b*, a refrigerant in the crank chamber 140 is discharged to the suction chamber 141 through the first discharge passage 146*a* and the second discharge passage 146*b*. Consequently, the pressure in the crank chamber 140 is reduced (to be equivalent to the pressure in the suction chamber 141). When the pressure in the crank chamber 140 is reduced, the inclination angle of the swash plate 111 increases and thus a stroke volume of the piston 136 (i.e., discharge volume of the variable displacement compressor 100) increases as well.

In contrast, when the first control valve 300 opens the supply passage 145, the refrigerant (high-pressure refrigerant) in the discharge chamber 142 is supplied to the crank chamber 140 and the second control valve 400 closes the second discharge passage 146*b*. When the second control valve 400 closes the second discharge passage 146*b*, the refrigerant in the crank chamber 140 is discharged to the suction chamber 141 only through the first discharge passage 146*a* with the throttle. That is, the discharging of the refrigerant in the crank chamber 140 to the suction chamber 141 is limited. As a result, the pressure in the crank chamber 140 increases. When the pressure in the crank chamber 140 increases, the inclination angle of the swash plate 111 decreases and thus the stroke volume of the piston 136 (discharge volume of the variable displacement compressor 100) decreases as well. Here, the pressure in the crank chamber 140 increases with increasing a supply amount of the refrigerant in the discharge chamber 142 which is to be supplied to the crank chamber 140. Thus, the stroke volume of the piston 136 (discharge volume of the variable displacement compressor 100) can be variably controlled according to the opening degree (passage cross-sectional area) of the supply passage 145 which is controlled by the first control valve 300.

As described above, the variable displacement compressor 100 of this embodiment is configured to vary the discharge volume by supplying the refrigerant in the discharge chamber 142 to the crank chamber 140 through the supply passage 145 and also discharging the refrigerant in the crank chamber 140 to the suction chamber 141 through the discharge passage (first discharge passage 146*a* and second discharge passage 146*b*) so as to adjust the pressure in the crank chamber 140. Accordingly, in this embodiment, the crank chamber 140 corresponds to a "controlled pressure chamber" of the present invention.

The variable displacement compressor 100 further includes a throttle passage 147 for discharging to the suction chamber 141 a refrigerant in the region of the supply passage 145 between the first control valve 300 and the check valve 500. In this embodiment, the throttle passage 147 is formed to allow communication between the suction chamber 141 and the part of the second control valve 400 which constitutes the part of the region of the supply passage 145 between the first control valve 300 and the check valve 500.

Moreover, the inside (mainly, crank chamber 140) of the variable displacement compressor 100 has a lubricating oil enclosed therein and is thus lubricated with the oil that is stirred by the swash plate 111 or other member along with the rotation of the drive shaft 110 or the oil that moves together with the refrigerant (gas).

Next, the first discharge passage 146*a*, the first control valve 300, the second control valve 400, the check valve 500, the supply passage 145, the second discharge passage 146*b*, and the throttle passage 147 of the variable displacement compressor 100 of this embodiment are described in detail.

First Discharge Passage 146*a*

Figure 3:
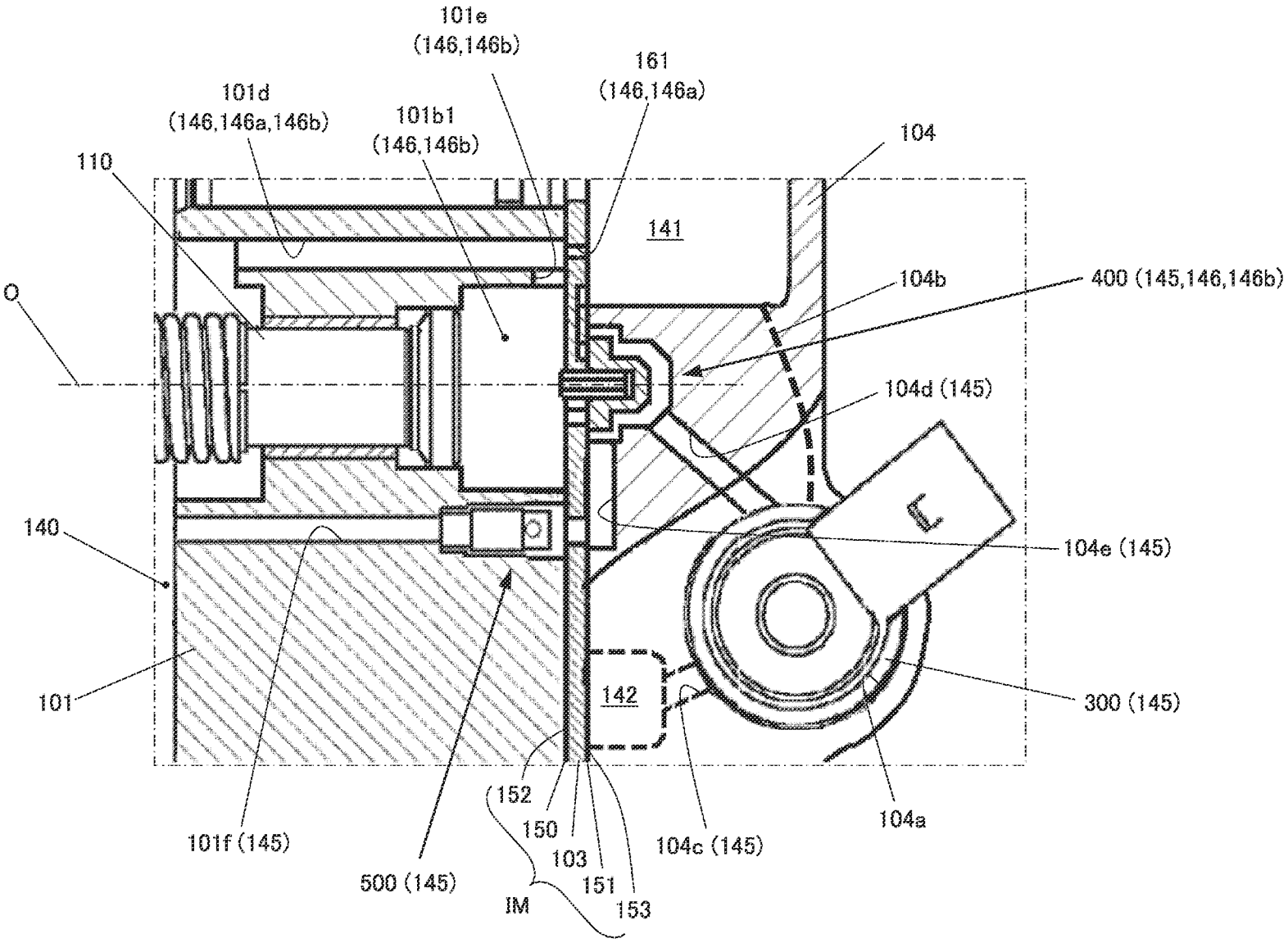
FIG. 3 is an enlarged view of a main part of FIG. 1.

FIG. 3 is an enlarged view of a main part of FIG. 1. In this embodiment, a first communication passage 101*d* and a throttle hole 161 constitute the first discharge passage 146*a* through which the crank chamber 140 and the suction chamber 141 communicate with each other all the time. The first communication passage 101*d* is formed in the cylinder block 101. The throttle hole 161 functions as the throttle portion. The first communication passage 101*d* has one end open to the crank chamber 140 and has the other end open to an end surface of the cylinder block 101 on the cylinder head 104 side. The throttle hole 161 passes through an intervening member IM that is interposed between the cylinder block 101 and the cylinder head 104. The throttle hole 161 allows connection between the suction chamber 141 and the other end of the first communication passage 101*d*. Here, the intervening member IM basically refers to the cylinder gasket 152, the suction valve forming plate 150, the valve plate 103, the discharge valve forming plate 151, and the head gasket 153, but sometimes does not contain the cylinder gasket 152 and/or the head gasket 153. The first communication passage 101*d* communicates with the large-diameter bore portion 101*b*1 of the center bore 101*b* through a second communication passage 101*e* that is formed in the cylinder block 101.

First Control Valve 300

Figure 4:
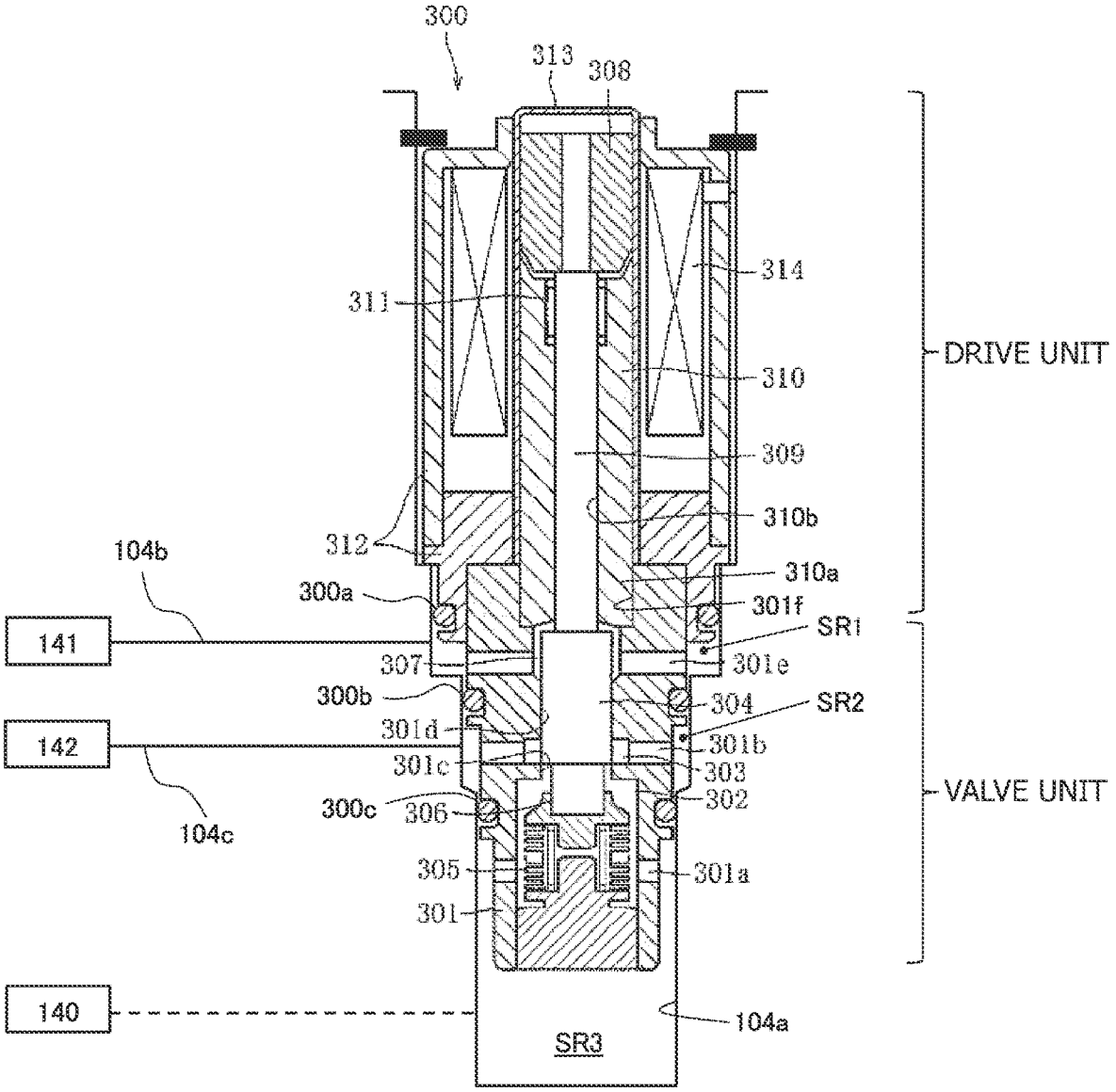
FIG. 4 is a sectional view of a first control valve of the variable displacement compressor.

FIG. 4 is a sectional view of the first control valve 300. As shown in FIGS. 3 and 4, the first control valve 300 is accommodated in an accommodation hole 104*a* that is formed in the cylinder head 104. To an outer peripheral surface of the first control valve 300, three O rings 300*a* to 300*c* are attached. The three O rings 300*a* to 300*c* partition an external space of the first control valve 300 in the accommodation hole 104*a* into first to third regions SR1 to SR3.

The first region SR1 communicates with the suction chamber 141 through a third communication passage 104*b* formed in the cylinder head 104. The second region SR2 communicates with the discharge chamber 142 through a fourth communication passage 104*c* formed in the cylinder head 104. The third region SR3 is connected to the crank chamber 140 through a fifth communication passage 104*d* formed in the cylinder head 104, the second control valve 400, a sixth communication passage 104*e* formed in the cylinder head 104, the check valve 500, and a seventh communication passage 101*f* formed in the cylinder block 101.

The first control valve 300 includes a valve unit and a drive unit (solenoid) that operates the valve unit to open or close. The first control valve 300 is configured to control the opening degree of the supply passage 145 in response to the pressure in the suction chamber 141 which is introduced through the third communication passage 104*b* and the first region SR1 and an electromagnetic force generated by a current flowing in the solenoid according to an external signal.

The valve unit of the first control valve 300 includes a cylindrical valve housing 301. In the valve housing 301, a first pressure sensitive chamber 302, a valve chamber 303, and a second pressure sensitive chamber 307 are arranged in this order from one end of the valve housing 301 (bottom side of the accommodation hole 104*a*) in an axial direction.

The first pressure sensitive chamber 302 communicates with the third region SR3 in the accommodation hole 104*a* through a first communication hole 301*a* formed in an outer peripheral surface of the valve housing 301.

The valve chamber 303 communicates with the second region SR2 in the accommodation hole 104*a* through a second communication hole 301*b* formed in the outer peripheral surface of the valve housing 301.

The second pressure sensitive chamber 307 communicates with the first region SR1 in the accommodation hole 104*a* through a third communication hole 301*e* formed in the outer peripheral surface of the valve housing 301.

The first pressure sensitive chamber 302 and the valve chamber 303 communicate with each other through a valve hole 301*c*. A support hole 301*d* is formed between the valve chamber 303 and the second pressure sensitive chamber 307.

In the first pressure sensitive chamber 302, a bellows 305 is installed. The inside of the bellows 305 is a vacuum space in which a spring is provided. The bellows 305 is displaceable in an axial direction of the valve housing 301. The bellows 305 functions as a pressure sensitive means that receives the pressure in the first pressure sensitive chamber 302, that is, mainly the pressure in the crank chamber 140.

The valve chamber 303 accommodates one end of a columnar valve body 304. The valve body 304 is slidably supported, at its outer peripheral surface, on the support hole 301*d* in a movable manner in the axial direction of the valve housing 301. The one end of the valve body 304 constitutes a valve portion for opening or closing the valve hole 301*c*. The other end of the valve body 304 protrudes into the second pressure sensitive chamber 307 and constitutes a pressure receiving portion that receives the pressure in the second pressure sensitive chamber 307, that is, the pressure in the suction chamber 141. Then, when the one end (valve portion) of the valve body 304 opens the valve hole 301*c*, the second region SR2 and the third region SR3 communicate with each other through the second communication hole 301*b*, the valve chamber 303, the valve hole 301*c*, the first pressure sensitive chamber 302, and the first communication hole 301*a*.

At a center portion of the one end of the valve body 304, a connection portion 306 protrudes axially. The connection portion 306 is removably connected, at its distal end, to the bellows 305, and functions as a transmitting portion that transmits displacement of the bellows 305 to the valve body 304.

The drive unit includes a cylindrical solenoid housing 312. The solenoid housing 312 is connected to the other end (side opposite to the bottom side of the accommodation hole 104*a*) of the valve housing 301. The solenoid housing 312 accommodates a substantially cylindrical molded coil 314 that is prepared by covering an electromagnetic coil with a resin. In the molded coil 314, a fixed core 310 and a movable core 308 are provided in a manner of being accommodated in an accommodating member 313 having a bottomed cylindrical shape.

The accommodating member 313 is placed with its open end facing the valve housing 301. The fixed core 310 has a protrusion 310*a* that protrudes from the open end of the accommodating member 313. The protrusion 310*a* of the fixed core 310 is fitted into a fitting hole 301*f* formed in the valve housing 301. A distal end surface of the protrusion 310*a* constitutes a wall surface of the second pressure sensitive chamber 307.

Moreover, the fixed core 310 has an insertion hole 310*b*. The insertion hole 310*b* passes through the fixed core 310 in a length direction (axial direction). That is, the insertion hole 310*b* has one end open to an end surface of the protrusion 310*a* and has the other end open to an end surface of the fixed core 310 opposite to the protrusion 310*a*.

To the insertion hole 310*b*, a solenoid rod 309 is inserted with some spaces therebetween. The solenoid rod 309 has one end fixed to the other end of the valve body 304 and has the other end fitted (press-fitted) into a through hole formed in the movable core 308. That is, the valve body 304, the movable core 308, and the solenoid rod 309 are integrated together.

Moreover, a forcibly releasing spring 311 is provided between the fixed core 310 and the movable core 308. The forcibly releasing spring 311 biases the movable core 308 in a direction away from the fixed core 310, that is, a direction (valve opening direction) in which the one end (valve portion) of the valve member 304 opens the valve hole 301*c*.

The movable core 308, the fixed core 310, and the solenoid housing 312 are formed of a magnetic material to constitute a magnetic circuit, whereas the accommodating member 313 is formed of a nonmagnetic material, for example, a stainless steel-based material.

The molded coil 314 is connected, for example, through a signal line to a control device (not shown) provided outside the variable displacement compressor 100. When a control current I is supplied to the molded coil 314 from the control device, the drive unit generates an electromagnetic force F(I). When the drive unit generates the electromagnetic force F(I), the movable core 308 is attracted toward the fixed core 310, so that the valve body 304 moves in a direction (valve closing direction) of closing the valve hole 301*c*.

Configuration of Second Control Valve 400

Figure 5A:
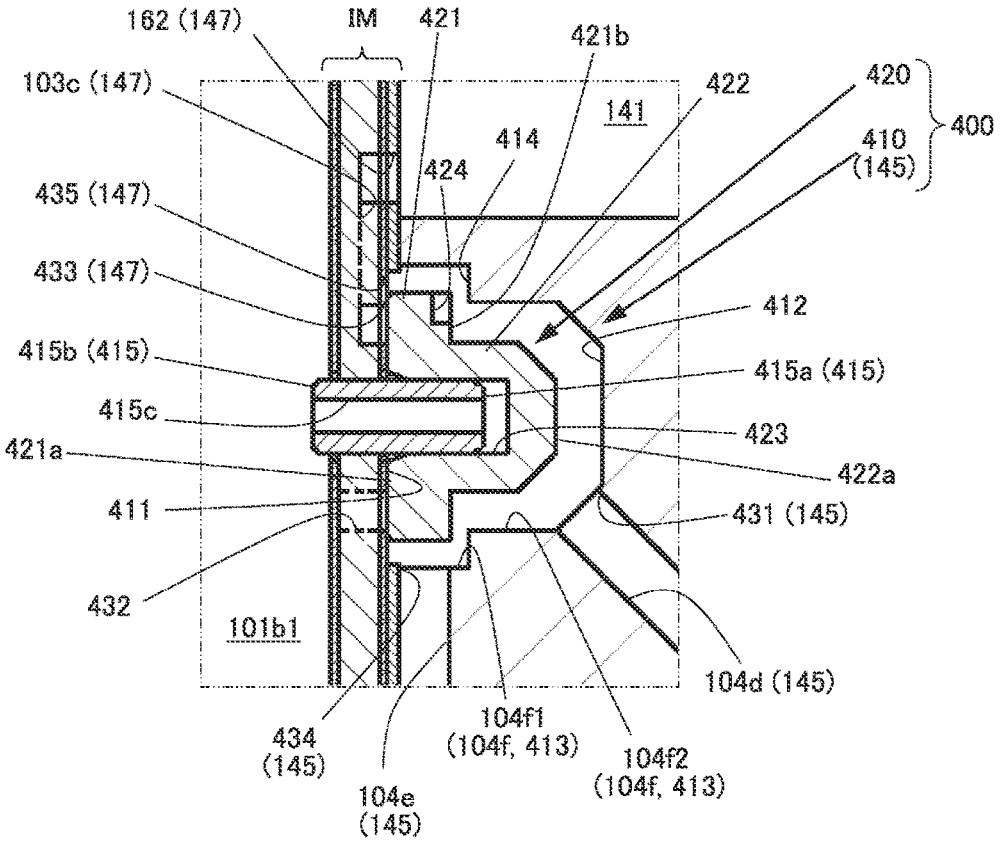
Figure 5B:
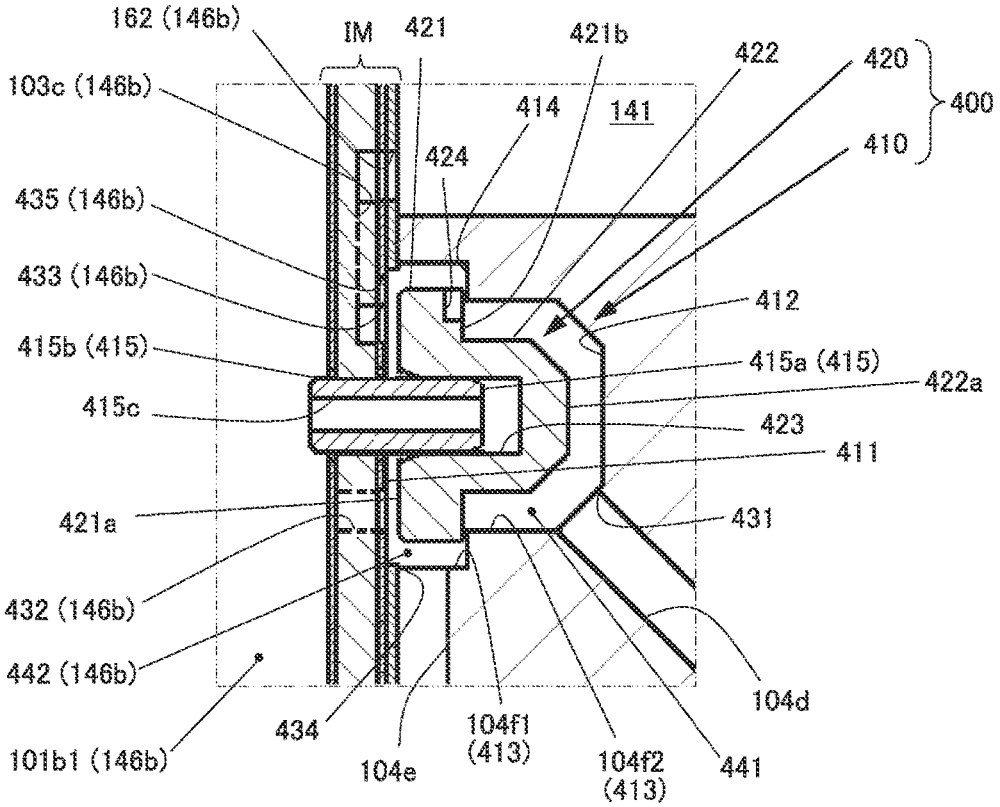

As shown in FIGS. 1 and 3, in this embodiment, the second control valve 400 is provided in the cylinder head 104 so as to lie on the extension of an axial line O of the drive shaft 110. FIGS. 5A and 5B are sectional views of the second control valve 400. FIG. 5A shows a state of the second control valve 400 when the first control valve 300 opens the valve hole 301*c* (i.e., the first control valve is opened). FIG. 5B shows a state of the second control valve 400 when the first control valve 300 closes the valve hole 301*c* (i.e., the first control valve is closed).

The second control valve 400 includes a valve chamber 410 and a valve body 420.

Figure 6:
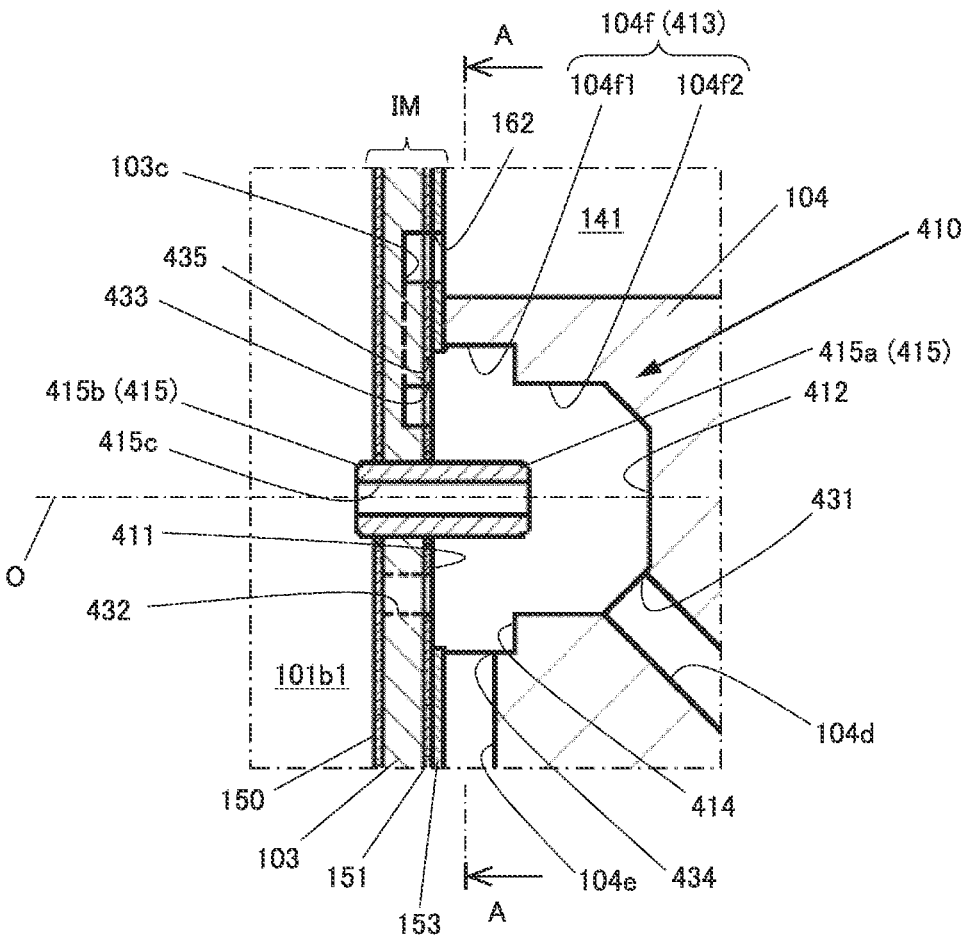
FIG. 6 is a sectional view of a valve chamber constituting the second control valve.

FIG. 6 is a sectional view of the valve chamber 410. The valve chamber 410 is mainly defined by the accommodation hole 104*f* that is formed in the cylinder head 104. The accommodation hole 104*f* is formed as a stepped, bottomed columnar hole that is open to an end surface of the cylinder head 104 on the cylinder block 101 side. That is, the accommodation hole 104*f* includes a large-diameter hole portion 104*f*1 and a small-diameter hole portion 104*f*2. The large-diameter hole portion 104*f*1 is open to the end surface of the cylinder head 104 on the cylinder block 101 side. The small-diameter hole portion 104*f*2 has a smaller diameter than the large-diameter hole portion 104*f*1 and is open to a bottom surface of the large-diameter hole portion 104*f*1.

The accommodation hole 104*f* is adjacent to the suction chamber 141 and also is opposite to the large-diameter bore portion 101*b*1 of the center bore 101*b* formed in the cylinder block 101, across the intervening member IM.

The opening of the accommodation hole 104*f* (i.e., opening of the large-diameter hole portion 104*f*1) is closed by the intervening member IM. In this embodiment, the surroundings of the opening of the accommodation hole 104*f* in the cylinder head 104 are in contact with the head gasket 153. The opening of the accommodation hole 104*f* is closed by the discharge valve forming plate 151. Note that the present invention is not limited thereto, and the opening of the accommodation hole 104*f* may be closed by the head gasket 153.

Then, a portion of the intervening member IM (in this example, the discharge valve forming plate 151), which closes the opening of the accommodation hole 104*f*, constitutes one end wall surface (hereinafter referred to as "first end wall surface") 411 of the valve chamber 410. A bottom surface of the accommodation hole 104*f* (bottom surface of the small-diameter hole portion 104*f*2) constitutes the other end wall surface (hereinafter referred to as "second end wall surface") 412 of the valve chamber 410, which faces the first end wall surface 411. An inner peripheral surface of the accommodation hole 104*f* constitutes a peripheral wall surface 413 of the valve chamber 410 which extends between the first end wall surface 411 and the second end wall surface 412. Moreover, the bottom surface (in other words, stepped surface between the large-diameter hole portion 104*f*1 and the small-diameter hole portion 104*f*2) of the large-diameter hole portion 104*f*1 in the accommodation hole 104*f* constitutes an extended surface 414 that extends radially inward from an intermediate portion in the extending direction of the peripheral wall surface 413. The extended surface 414 is an annular surface that is parallel to the first end wall surface 411.

To the portion of the intervening member IM, which closes the opening of the accommodation hole 104*f*, a columnar shaft member 415 is fixed. In this embodiment, the shaft member 415 lies on the extension of the axial line O of the drive shaft 110. That is, the axial line of the shaft member 415 is in alignment with the extension of the axial line O of the drive shaft 110. The shaft member 415 is fixed with its intermediate portion in the length direction (axial direction) being fitted to a fitting hole that is formed in the intervening member IM (in this example, mainly the valve plate 103). The shaft member 415 includes a guide shaft portion 415*a* and a protrusion 415*b*. The guide shaft portion 415*a* protrudes from the first end wall surface 411 toward the second end wall surface 412 in the valve chamber 410. The protrusion 415*b* protrudes into the large-diameter bore portion 101*b*1 of the center bore 101*b*. Moreover, in this embodiment, the shaft member 415 has a shaft through hole 415*c* that passes through the shaft member 415 in the axial direction (i.e., passes from a distal end surface of the guide shaft portion 415*a* to a distal end surface of the protrusion 415*b*).

At a portion of the peripheral wall surface 413 of the valve chamber 410 closer to the second end wall surface 412 than the extended surface 414, one end of the fifth communication passage 104*d* is open as a first port 431. The other end of the fifth communication passage 104*d* is open to the third region SR3 in the accommodation hole 104*a* which accommodates the first control valve 300. Specifically, the first port 431 communicates with the fifth communication passage 104*d* between the first control valve 300 and the second control valve 400. More specifically, the first port 431 communicates with the third region SR3 through the fifth communication passage 104*d*. Here, the one end of the fifth communication passage 104*d* may be open, as the first port 431, to the second end wall surface 412 of the valve chamber 410 in place of the portion of the peripheral wall surface 413 of the valve chamber 410 closer to the second end wall surface 412 than the extended surface 414.

At the first end wall surface 411 of the valve chamber 410, at least one second port 432 and at least one third port 433 are open. The second port 432 passes through the intervening member IM. The second port 432 communicates with the crank chamber 140 through the large-diameter bore portion 101*b*1 of the center bore 101*b*, the second communication passage 101*e*, and the first communication passage 101*d* (see FIG. 3). The third port 433 passes through the discharge valve forming plate 151. The third port 433 communicates with the suction chamber 141 through a communication groove 103*c* and a connection hole 162. The communication groove 103*c* is formed in the valve plate 103 so as to extend from a position corresponding to the third port 433 to a position corresponding to the suction chamber 141. The connection hole 162 passes through the discharge valve forming plate 151 and the head gasket 153 to connect between the communication groove 103*c* and the suction chamber 141.

At a portion of the peripheral wall surface 413 of the valve chamber 410 closer to the first end wall surface 411 than the extended surface 414, one end of the sixth communication passage 104*e* is open as a fourth port 434. The sixth communication passage 104*e* extends along the intervening member IM and has the other end connected to the check valve 500 (see FIG. 3). That is, the fourth port communicates with the sixth communication passage 104*e* between the second control valve 400 and the check valve 500.

Figure 7:
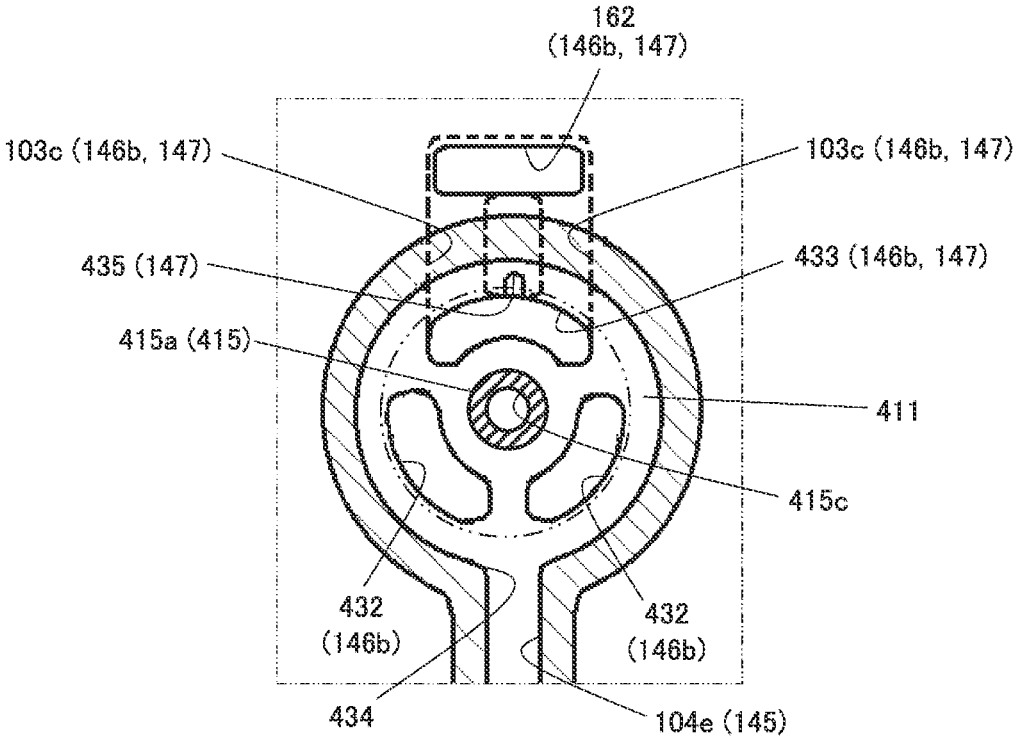
FIG. 7 is a sectional view taken along line A-A of FIG. 6.

FIG. 7 is an enlarged sectional view taken along line A-A of FIG. 6. As shown in FIG. 7, a guide shaft portion 415*a* (shaft member 415) lies at the center of the first end wall surface 411 of the valve chamber 410. In this embodiment, two second ports 432 and one third port 433 are open to the first end wall surface 411 of the valve chamber 410. The two second ports 432 and the one third port 433 are each formed as an arc-shaped hole with the axial line of the guide shaft portion 415*a* (shaft member 415) at its center, so as to surround the guide shaft portion 415*a*. However, the present invention is not limited thereto and the shape or numbers of second ports 432 and third ports 433 may be freely set. Here, an opening area (total opening area) of the second port(s) 432 is set to be larger than that of the third port(s) 433.

The communication groove 103*c* formed in the valve plate 103 has a groove width corresponding to the third port 433. The connection hole 162 is formed as a rectangular hole with a slightly smaller longitudinal dimension than the communication groove 103*c*.

Moreover, the first end wall surface 411 of the valve chamber 410 has a notch 435 that is formed by partially cutting a radially outer portion of the third port 433. Similar to the third port 433, the notch 435 passes through the discharge valve forming plate 151 and communicates with the suction chamber 141 through the communication groove 103*c* formed in the valve plate 103 and the connection hole 162 that passes through the discharge valve forming plate 151 and the head gasket 153.

Here, in this embodiment, as shown in FIG. 7, the communication groove 103*c* contains two passages. Moreover, the notch 435 is formed to extend to a radially outer side of a contact portion between the first end wall surface 411 and one end surface 421*a* of a large-diameter portion 421 in the valve body 420, described later. When the one end surface 421*a* of the large-diameter portion 421 in the valve body 420 comes into contact with the first end wall surface 411, an end portion of the notch 435 on the third port 433 side is covered with the one end surface 421*a* of the large-diameter portion 421 in the valve body 420. Then, at this time, the valve chamber 410 communicates with the suction chamber 141 through a region of the notch 435 between the one end surface 421*a* of the large-diameter portion 421 in the valve body 420 and an end surface of the valve plate 103, the third port 433, the communication groove 103*c*, and the connection hole 162. Note that the double-dot dashed line in FIG. 7 indicates a region that is covered with the large-diameter portion 421 of the valve body 420 when the one end surface 421*a* of the large-diameter portion 421 in the valve body 420, described later, comes into contact with the first end wall surface 411.

Referring back to FIGS. 5A and 5B, the valve body 420 is formed in a stepped columnar shape and has the large-diameter portion 421 and a small-diameter portion 422 with a smaller diameter than the large-diameter portion 421. The large-diameter portion 421 of the valve body 420 has a smaller diameter than the large-diameter hole portion 104*f*1 of the accommodation hole 104*f* that constitutes the valve chamber 410 as well as has a larger diameter than the small-diameter hole portion 104*f*2. The small-diameter portion 422 of the valve body 420 has a smaller diameter than the small-diameter hole portion 104*f*2.

The valve body 420 has a receiving portion 423 to which the guide shaft portion 415*a* is slidably inserted. In this embodiment, the receiving portion 423 is open at the center of the one end surface 421*a* of the large-diameter portion 421. Also, the receiving portion 423 is formed as a columnar, bottomed guide hole extending along the center line of the valve body 420. The receiving portion 423 as the guide hole has a larger depth than the length of the guide shaft portion 415*a*. The center line of the valve body 420 is in alignment with the axial line of the guide shaft portion 415*a* (shaft member 415). Moreover, the other end surface 421*b* of the large-diameter portion 421 has a notched groove 424 that extends radially inward from a peripheral edge portion thereof.

The valve body 420 is accommodated in the valve chamber 410 with the guide shaft portion 415*a* being inserted to the receiving portion 423. That is, the valve body 420 is accommodated in the valve chamber 410 such that the large-diameter portion 421 lies closer to the first end wall surface 411 in the valve chamber 410 as well as the small-diameter portion 422 lies closer to the second end wall surface 412 in the valve chamber 410. Then, with the guide shaft portion 415*a* being slidably inserted to the receiving portion 423, the valve body 420 is supported movably in the valve chamber 410 in the axial direction of the guide shaft portion 415*a* (shaft member 415), that is, in the direction perpendicular to the first end wall surface 411, without contact with the peripheral wall surface 413 of the valve chamber 410. The bottom portion (closed space) of the receiving portion (bottomed hole) 423 of the valve body 420 communicates with the crank chamber 140 through the shaft through hole 415*c* formed in the guide shaft portion 415*a* (shaft member 415), the large-diameter bore portion 101*b*1 of the center bore 101*b*, the second communication passage 101*e*, and the first communication passage 101*d*, so that the pressure in the crank chamber 140 is introduced to the bottom portion (see FIG. 3).

In this example, a gap between the guide shaft portion 415*a* (outer peripheral surface thereof) and the receiving portion 423 (inner peripheral surface thereof) is preferably set to 0.1 mm to 0.4 mm although not particularly limited thereto. This is because an excessively small gap allows the intrusion of minute foreign matter therein to block the movement of the valve body 420, whereas an excessively large gap may not ensure stable movement of the valve body 420. Moreover, the valve body 420 is preferably formed to have its center of gravity on the guide shaft portion 415*a* even when it moves to the farthest position from the first end wall surface 411.

The valve body 420 is restricted from moving in one direction when the one end surface 421*a* of the large-diameter portion 421 comes into contact with the first end wall surface 411 of the valve chamber 410 and is restricted from moving in the other direction when the other end surface 421*b* of the large-diameter portion 421 comes into contact with the extended surface 414 of the valve chamber 410. That is, the valve body 420 is configured as follows. When the one end surface 421*a* of the large-diameter portion 421 comes into contact with the first end wall surface 411 of the valve chamber 410, the other end surface 421*b* of the large-diameter portion 421 separates from the extended surface 414 of the valve chamber 410. When the other end surface 421*b* of the large-diameter portion 421 comes into contact with the extended surface 414 of the valve chamber 410, the one end surface 421*a* of the large-diameter portion 421 separates from the first end wall surface 411 of the valve chamber 410. Note that when the other end surface 421*b* of the large-diameter portion 421 comes into contact with the extended surface 414, a sufficiently large gap is secured between a distal end surface 422*a* of the small-diameter portion 422 and the second end wall surface 412 (bottom surface of the accommodation hole 1040 (see FIG. 5B).

Then, as shown in FIG. 5A, when the one end surface 421*a* of the large-diameter portion 421 in the valve body 420 comes into contact with the first end wall surface 411 of the valve chamber 410, the second port 432 and the third port 433 are closed. Moreover, the other end surface 421*b* of the large-diameter portion 421 of the valve body 420 separates from the extended surface 414, so that the first port 431 and the fourth port 434 communicate with each other through the valve chamber 410. Here, even when the one end surface 421*a* of the large-diameter portion 421 in the valve body 420 comes into contact with the first end wall surface 411, the notch 435 formed in the first end wall surface 411 is not closed (see FIG. 7).

In contrast, as shown in FIG. 5B, when the other end surface 421*b* of the large-diameter portion 421 of the valve body 420 comes into contact with the extended surface 414, the inside of the valve chamber 410 is partitioned into a first space (space on the second end wall surface 412 side) 441 and a second space (space on the first end wall surface 411 side) 442. At the first space 441, the first port 431 is open. At the second space 442, the second port 432, the third port 433, and the fourth port 434 are open. Here, the first space 441 and the second space 442 communicate with each other through the notched groove 424 formed in the other end surface 421*b* of the large-diameter portion 421 of the valve body 420. Moreover, since the one end surface 421*a* of the large-diameter portion 421 in the valve body 420 separates from the first end wall surface 411 of the valve chamber 410, the second port 432 and the third port 433 are opened to communicate with each other through the second space 442.

The valve body 420 can be formed of, for example, metal or a resin material but preferably is formed of the resin material in view of weight reduction. If the valve body 420 is formed of the resin material, the resin material can be selected as appropriate from a polyphenylene sulfide (PPS) resin and a nylon-based (polyamide) resin, for example. Moreover, a non-adhesive coat layer or other layer may be formed on the first end wall surface 411 of the valve chamber 410 or the one end surface 421*a* of the large-diameter portion 421 in the valve body 420. In this case, a fluorene-based resin such as polytetrafluoroethylene (PTFE) can be used for the coat layer, for example. With this structure, the one end surface 421*a* of the large-diameter portion 421 of the valve body 420 is less adhesive to the first end wall surface 411, to thereby allow the valve body 420 to smoothly separate from the first end wall surface 411.

Configuration of Check Valve 500

Figure 8A:
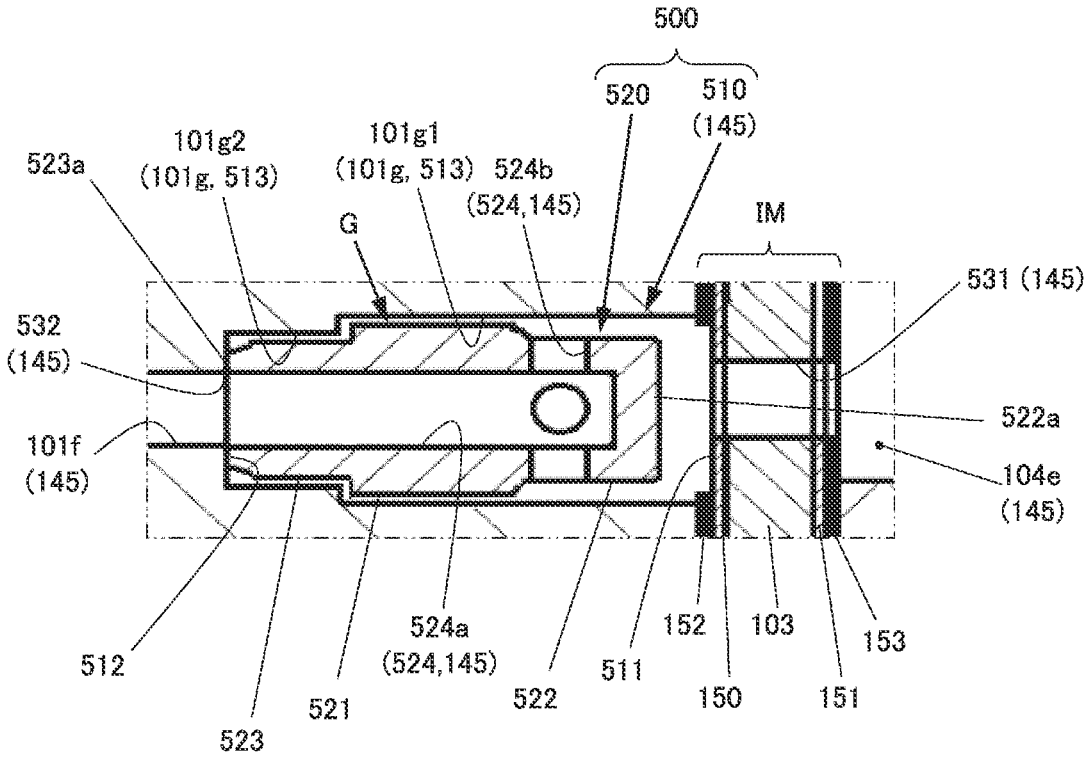
Figure 8B:
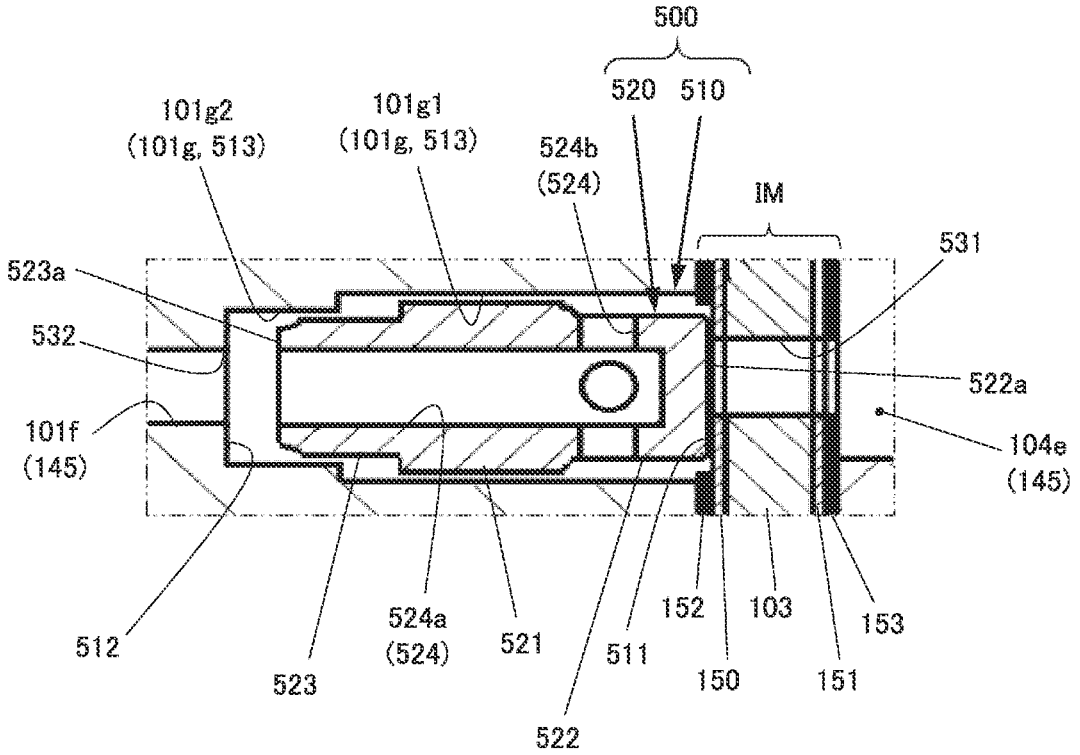

As shown in FIGS. 1 and 3, in this embodiment, the check valve 500 is provided below the drive shaft 110. FIGS. 8A and 8B are sectional views of the check valve 500. FIG. 8A shows a state of the check valve 500 when the first control valve 300 is opened (when the valve hole 301*c* is opened). FIG. 8B shows a state of the check valve 500 when the first control valve 300 is closed (when the valve hole 301*c* is closed).

The check valve 500 includes a valve chamber (hereinafter referred to as "check valve chamber") 510 and a valve body (hereinafter referred to as "check valve body") 520.

The check valve chamber 510 is mainly defined by an accommodation hole 101*g* formed in the cylinder block 101. The accommodation hole 101*g* is formed as a stepped, columnar bottomed hole that is open to an end surface of the cylinder block 101 on the cylinder head 104 side. That is, the accommodation hole 101*g* includes a large-diameter hole portion 101*g*1 and a small-diameter hole portion 101*g*2. The large-diameter hole portion 101*g*1 is open to the end surface of the cylinder block 101 on the cylinder head 104 side. The small-diameter hole portion 101*g*2 has a smaller diameter than the large-diameter hole portion 101*g*1 and also is open to a bottom surface of the large-diameter hole portion 101*g*1.

The opening of the accommodation hole 101*g* (i.e., opening of the large-diameter hole portion 101*g*1) is closed by the intervening member IM. Specifically, in this embodiment, a portion around the opening of the accommodation hole 101*g* in the cylinder block 101 comes into contact with the cylinder gasket 152, and the opening of the accommodation hole 101*g* is closed by the suction valve forming plate 150. Note that the opening of the accommodation hole 101*g* may be closed by the cylinder gasket 152.

Then, as shown in FIGS. 8A and 8B, a portion of the intervening member IM (in this example, the suction valve forming plate 150), which closes the opening of the accommodation hole 101*g*, constitutes one end wall surface 511 of the check valve chamber 510. A bottom surface of the accommodation hole 101*g* (i.e., bottom surface of the small-diameter hole portion 101*g*2) constitutes the other end wall surface 512 of the check valve chamber 510. An inner peripheral surface of the accommodation hole 101*g* constitutes a peripheral wall surface 513 of the check valve chamber 510 which extends between the one end wall surface 511 and the other end wall surface 512.

At the one end wall surface 511 of the check valve chamber 510, a fifth port 531 is open. The fifth port 531 passes through the intervening member IM and is connected to the other end side of the sixth communication passage 104*e*.

At the other end wall surface 512 of the check valve chamber 510, one end of the seventh communication passage 101*f* is open as a sixth port 532. The other end of the sixth port 532 is open to the crank chamber 140. In other words, the sixth port 532 communicates with the crank chamber 140 through the seventh communication passage 101*f*.

The check valve body 520 is formed in a stepped columnar shape and includes a large-diameter portion 521, a first small-diameter portion 522, and a second small-diameter portion 523. The first small-diameter portion 522 has a smaller diameter than the large-diameter portion 521 and protrudes from one end surface of the large-diameter portion 521. The second small-diameter portion 523 has a smaller diameter than the large-diameter portion 521 and protrudes from the other end surface of the large-diameter portion 521.

The diameter of the large-diameter portion 521 of the check valve body 520 is smaller than the large-diameter hole portion 101*g*1 of the accommodation hole 101*g* that constitutes the check valve chamber 510. Also, the diameter is larger than the small-diameter hole portion 101*g*2. The second small-diameter portion 523 of the valve body has a smaller diameter than the small-diameter hole portion 101*g*2. Here, a predetermined gap is formed between an outer peripheral surface of the check valve body 520 and the peripheral wall surface 513 of the check valve chamber 510.

Moreover, an internal passage 524 is formed in the check valve body 520. The internal passage 524 includes a first passage 524*a* and at least one second passage 524*b*. The first passage 524*a* has one end open to an end surface 523*a* of the second small-diameter portion 523. The first passage 524*a* extends toward an end surface 522*a* of the first small-diameter portion 522 and is closed at the other end. The second passage 524*b* has one end open to a side surface (peripheral surface) of the first small-diameter portion 522 and has the other end open to the first passage 524*a*. Preferably, a plurality of (for example, four) second passages 524*b* are formed at regular intervals in the circumferential direction.

The check valve body 520 is accommodated in the check valve chamber 510 such that the first small-diameter portion 522 lies closer to the one end wall surface 511 of the check valve chamber 510 and also the second small-diameter portion 523 lies closer to the other end wall surface 512 of the check valve chamber 510. Moreover, the check valve body 520 is movable toward the one end wall surface 511 and the other end wall surface 512 in the check valve chamber 510.

The check valve body 520 is restricted from moving in one direction by the end surface 522*a* of the first small-diameter portion 522 coming into contact with the one end wall surface 511 of the check valve chamber 510 and is restricted from moving in the other direction by the end surface 523*a* of the second small-diameter portion 523 coming into contact with the other end wall surface 512 of the check valve chamber 510.

Then, as shown in FIG. 8A, when the end surface 522*a* of the first small-diameter portion 522 of the check valve body 520 separates from the one end wall surface 511 of the check valve chamber 510, the fifth port 531 is opened to allow the fifth port 531 and the sixth port 532 to communicate with each other through the check valve chamber 510 and the internal passage 524.

In contrast, as shown in FIG. 8B, when the end surface 522*a* of the first small-diameter portion 522 of the check valve body 520 comes into contact with the one end wall surface 511 of the check valve chamber 510, the fifth port 531 is closed to block the communication between the fifth port 531 and the sixth port 532.

Similar to the valve body 420 of the second control valve 400, the check valve body 520 can be also formed of, for example, metal or a resin material but preferably is formed of the resin material in view of weight reduction. Moreover, a non-adhesive coat layer or other layer may be formed on the one end wall surface 511 of the check valve chamber 510 and/or the end surface 522*a* of the first small-diameter portion 522 of the check valve body 520.

Supply Passage 145

As described above, when the first control valve 300 is opened, the second region SR2 and the third region SR3 that communicate with the discharge chamber 142 through the fourth communication passage 104*c*, communicate with each other through the second communication hole 301*b*, the valve chamber 303, the valve hole 301*c*, the first pressure sensitive chamber 302, and the first communication hole 301*a* of the first control valve 300. In the second control valve 400, the first port 431 that communicates with the third region SR3 through the fifth communication passage 104*d* and the fourth port 434 as one end of the sixth communication passage 104*e* communicate with each other through the valve chamber 410 (see FIG. 5A). In the check valve 500, the fifth port 531 that is connected to the sixth communication passage 104*e* and the sixth port 532 that communicates with the crank chamber 140 through the seventh communication passage 101*f*, communicate with each other through the check valve chamber 510 and the internal passage 524 of the check valve body 520 (see FIG. 8A).

Thus, the discharge chamber 142 and the crank chamber 140 communicate with each other through a first passage including the fourth communication passage 104*c*, the second region SR2, the first control valve 300 (second communication hole 301*b*, valve chamber 303, valve hole 301*c*, first pressure sensitive chamber 302, and first communication hole 301*a*), the third region SR3, the fifth communication passage 104*d*, the second control valve 400 (first port 431, valve chamber 410, and fourth port 434), the sixth communication passage 104*e*, the check valve 500 (fifth port 531, check valve chamber 510 and internal passage 524, and sixth port 532), and the seventh communication passage 101*f*. The refrigerant in the discharge chamber 142 (high-pressure refrigerant) is supplied to the crank chamber 140 through the first passage. In other words, in this embodiment, the first passage forms the supply passage 145. Then, when the first control valve 300 adjusts the opening degree of the valve hole 301*c* (opens or closes the valve hole 301*c*), the opening degree of the supply passage 145 is adjusted (to be opened or closed), so that the check valve 500 opens or closes the fifth port 531 in synchronization with opening or closing of the first control valve 300.

Second Discharge Passage 146*b*

When the first control valve 300 is closed, the valve hole 301*c* (i.e., supply passage 145) is closed, so that the refrigerant in the discharge chamber 142 is not supplied to the crank chamber 140. Moreover, as described above, when the first control valve 300 is closed, in the check valve 500, the fifth port 531 is closed (see FIG. 8B). In the second control valve 400, the inside of the valve chamber 410 is partitioned into the first space 441 and the second space 442. At the first space 441, the first port 431 is open. At the second space 442, the second port 432, the third port 433, and the fourth port 434 are open. Also, the second port 432 and the third port 433 (and notch 435) communicate with each other through the second space 442 (see FIG. 5B). In this example, the second port 432 communicates with the crank chamber 140 through the large-diameter bore portion 101*b*1 of the center bore 101*b*, the second communication passage 101*e*, and the first communication passage 101*d*. The third port 433 (and notch 435) communicates with the suction chamber 141 through the communication groove 103*c* formed in the valve plate 103 and the connection hole 162 that passes through the intervening member IM.

Thus, the crank chamber 140 and the suction chamber 141 communicate with each other not only through the first discharge passage 146*a* but also through a second passage including the first communication passage 101*d*, the second communication passage 101*e*, the large-diameter bore portion 101*b*1 of the center bore 101*b*, the second control valve 400 (second port 432, second space 442, third port 433, and notch 435), the communication groove 103*c*, and the connection hole 162. With this structure, the refrigerant in the crank chamber 140 is discharged to the suction chamber 141 through the first discharge passage 146*a* and the second passage. In other words, in this embodiment, the second passage forms the second discharge passage 146*b*. When the second port 432 and the third port 433 are closed in the second control valve 400, the second discharge passage 146*b* is closed.

Throttle Passage 147

As described above, the valve chamber 410 of the second control valve 400 constitutes a part of the supply passage 145 and lies between the first control valve 300 and the check valve 500 in the supply passage 145. The valve chamber 410 of the second control valve 400 communicates with the suction chamber 141 through a third passage including the notch 435, the third port 433, the communication groove 103*c*, and the connection hole 162 (see FIG. 5A and FIG. 7). Through the third passage, a refrigerant in a region of the supply passage 145 between the first control valve 300 and the check valve 500 is discharged to the suction chamber 141. In this example, as described above, the valve chamber 410 of the second control valve communicates with the suction chamber 141 through the region of the notch 435 between the one end surface 421*a* of the large-diameter portion 421 in the valve body 420 and the end surface of the valve plate 103, the third port 433, the communication groove 103*c*, and the connection hole 162. The region of the notch 435 between the one end surface 421*a* of the large-diameter portion 421 in the valve body 420 and the end surface of the valve plate 103 functions as a "throttle". Thus, in this embodiment, the third passage forms the throttle passage 147.

Operation of First Control Valve 300

The valve body 304 of the first control valve 300 receives, in addition to the electromagnetic force F(I) generated by the drive unit, a biasing force f applied by the forcibly releasing spring 311, the force generated by the pressure in the valve chamber 303 (pressure Pd in the discharge chamber 142), the force generated by the pressure in the first pressure sensitive chamber 302 (pressure Pc in the crank chamber 140), the force generated by the pressure in the second pressure sensitive chamber 307 (pressure Ps of the suction chamber 141), and a biasing force F applied by an internal spring of the bellows 305.

Here, an effective pressure receiving area Sb of the bellows 305, a seal area Sv that is an area of the valve hole 301*c* sealed by the valve body 304, and a pressure receiving area Sr of the one end portion (valve portion) of the valve body 304 are set to be equal (Sb=Sv=Sr). Thus, the force generated by the pressure Pd in the discharge chamber 142 and the force generated by the pressure Pc in the crank chamber 140 are eliminated. At this time, the balance of the forces acting on the valve body 304 is represented by Expression 1 below. Expression 1 is transformed into Expression 2 below. In Expressions 1 and 2, "+" indicates a direction in which the valve body 304 closes the valve hole 301*c* (valve closing direction of the valve body 304) and "−" indicates a direction in which the valve body 304 opens the valve hole 301*c* (valve opening direction of the valve body 304).

$$F(I)-f+Ps\cdot Sb-F=0 \quad (1)$$

$$Ps=(F+f-F(I))/Sb \quad (2)$$

When the pressure in the suction chamber 141 exceeds a set pressure that is set according to the control current I, a connected structure of the bellows 305, the connection portion 306, and the valve body 304 decreases the opening degree (passage cross-sectional area) of the valve hole 301*c* (i.e., supply passage 145) to reduce the pressure in the crank chamber 140 so as to increase the discharge volume. When the pressure in the suction chamber 141 falls below the set pressure, the connected structure increases the opening degree of the valve hole 301*c* (i.e., supply passage 145) to increase the pressure in the crank chamber 140 so as to decrease the discharge volume. In other words, the first control valve 300 autonomously controls the opening degree of the supply passage 145 so as to bring the pressure in the suction chamber 141 closer to the set pressure.

Figure 9:
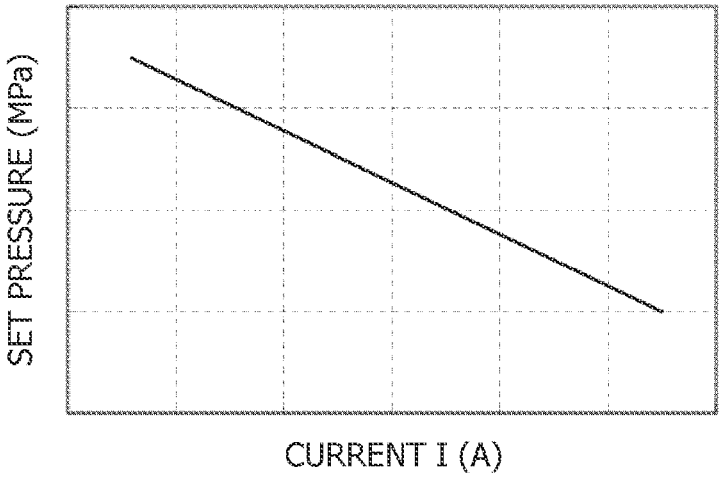
FIG. 9 is a graph showing an example of a relationship between an amount of current supply to a coil and a set pressure (of a suction chamber) in the first control valve.

Since the electromagnetic force of the drive unit acts on the valve body 304 in the valve closing direction via the solenoid rod 309, when more current is supplied to the molded coil 314, the force acting in the direction of decreasing the opening degree of the supply passage 145 (i.e., valve closing direction) is increased. At this time, the set pressure is changed to decrease as shown in FIG. 9. The control device controls current supply to the molded coil 314 by means of pulse width modulation (PWM control) with a predetermined frequency of 400 Hz to 500 Hz, for example, to change a pulse width (duty ratio) so that a desired amount of current flows through the molded coil 314.

When the air conditioner system is in operation, in other words, when the variable displacement compressor 100 is in operation, the control device adjusts an amount of current supply to the molded coil 314 based on the settings for air conditioning (for example, a set temperature) in the air conditioner system or an ambient environment. With this adjustment, the discharge volume of the variable displacement compressor 100 is controlled so that the pressure in the suction chamber 141 becomes the set pressure corresponding to the amount of current supply. In contrast, when the air conditioner system is not in operation, in other words, the variable displacement compressor 100 is not in operation, the control device stops current supply to the molded coil 314. With this operation, the supply passage 145 is opened by the forcibly releasing spring 311 and thus the discharge volume of the variable displacement compressor 100 is controlled to a minimum value.

Operation of Second Control Valve 400 and Check Valve 500

Assuming that F1 is the force of pressing the valve body 420 toward the second end wall surface 412 of the valve chamber 410 and F2 is the force of pressing the valve body 420 toward the first end wall surface 411 of the valve chamber 410 in the second control valve 400, F1 and F2 are represented by the following expressions.

$$F1=Ps\times S1+Pc\times S2$$

$$F2=Pm\times(S1+S2)$$

where Ps is the pressure in the suction chamber 141, Pc is the pressure in the crank chamber 140, Pm is the pressure in the valve chamber 410, S1 is an area on which the pressure in the suction chamber 141 acts, and S2 is an area on which the pressure in the crank chamber 140 acts (inclusive of a bottom area of the receiving portion 423). Here, S2>S1 is satisfied.

In this example, it is assumed that when the variable displacement compressor 100 is not in operation, the second control valve 400 is in a state as shown in FIG. 5A and the check valve 500 is in a state as shown in FIG. 8A. As described above, when the variable displacement compressor 100 is not in operation, the first control valve 300 opens the supply passage 145.

In the above state, the discharge passage 146 contains only the first discharge passage 146*a* and the discharge check valve 200 closes the communication passage 144. Thus, when the drive shaft 110 of the variable displacement compressor 100 is driven, the refrigerant (high-pressure refrigerant) that has been compressed by the reciprocating movement of the piston 136 and discharged to the discharge chamber 142, is introduced to the crank chamber 140 through the supply passage 145. With this operation, the pressure in the crank chamber 140 increases and the stroke volume (discharge volume) of the piston 136 is maintained at minimum.

After that, when a current is supplied to the molded coil 314 of the first control valve 300, the first control valve 300 closes the supply passage 145. Then, the refrigerant in the discharge chamber 142 is not supplied to the valve chamber 410 of the second control valve 400. Moreover, the refrigerant in the valve chamber 410 of the second control valve 400 is discharged to the suction chamber 141 through the throttle passage 147. Thus, the pressure in the valve chamber 410 of the second control valve 400 decreases. The valve chamber 410 of the second control valve 400 communicates with the crank chamber 140 through the sixth communication passage 104*e*, the check valve 500, and the seventh communication passage 101*f*, so that the refrigerant in the crank chamber 140 flows out to the seventh communication passage 101*f*. That is, the refrigerant flows back from the crank chamber 140 toward the valve chamber 410 of the second control valve 400. The check valve body 520 of the check valve 500 is pressed by the refrigerant thus flowing back, to close the fifth port 531 (check valve 500 is in a state as shown in FIG. 8B). With this operation, the flow of the refrigerant from the crank chamber 140 toward the first control valve 300 side is blocked.

When the check valve body 520 of the check valve 500 closes the fifth port 531, the pressure in the valve chamber 410 of the second control valve 400 becomes equal to the pressure in the suction chamber 141. That is, Pm=Ps and F1−F2=(Pc−Ps)×S2(Pc>Ps) are satisfied.

Accordingly, in the second control valve 400, if "(Pc−Ps)×S2" exceeds a resistance f1 required for the one end surface 421*a* of the large-diameter portion 421 in the valve body 420 to separate from the first end wall surface 411, the one end surface 421*a* of the large-diameter portion 421 in the valve body 420 separates from the first end wall surface 411 and the other end surface 421*b* of the large-diameter portion 421 of the valve body 420 comes into contact with the extended surface 414. That is, the second control valve 400 is in a state as shown in FIG. 5B. As a result, the second port 432 and the third port 433 (and notch 435) communicate with each other through the second space 442, to open the second discharge passage 146*b*.

In other words, when the first control valve 300 closes the supply passage 145, the check valve 500 also closes the supply passage 145, so that the second discharge passage 146*b* is opened and at this time, the discharge passage 146 contains the first discharge passage 146*a* and the second discharge passage 146*b*. That is, the discharge passage 146 has a maximum opening degree. Thus, the refrigerant in the crank chamber 140 is immediately discharged to the suction chamber 141 and the pressure in the crank chamber 140 becomes equivalent to the pressure in the suction chamber 141, so that the stroke volume (discharge volume) of the piston 136 is at maximum. Then, the pressure of the refrigerant which has been compressed by the reciprocating movement of the piston 136 and then discharged to the discharge chamber 142, is increased and the discharge check valve 200 opens the communication passage 144, so that the refrigerant circulates in the refrigerant circuit of the air conditioner system.

Note that in the second control valve 400, when the other end surface 421*b* of the large-diameter portion 421 of the valve body 420 comes into contact with the extended surface 414, the first space 441 and the second space 442 communicate with each other through the notched groove 424 formed in the other end surface 421*b* of the large-diameter portion 421 of the valve body 420, so that the pressure in the first space 441 and that in the second space 442 become substantially equal. Thus, the valve body 420 is pressed by the refrigerant flowing into the second space 442 from the second port 432, with which the other end surface 421*b* of the large-diameter portion 421 is maintained in contact with the extended surface 414.

When the variable displacement compressor 100 is operated with the maximum stroke volume (discharge volume) of the piston 136 and the pressure in the suction chamber 141 decreases to the set pressure corresponding to an amount of current supply to the molded coil 314, the first control valve 300 opens the supply passage 145 and then the refrigerant in the discharge chamber 142 flows into the first space 441. Since the first space 441 communicates with the second space 442 only through the notched groove 424 and is thus substantially a closed space, the pressure Pm in the first space 441 (i.e., pressure in the valve chamber 410) increases instantaneously. Assuming that S3 is an area of the first space 441 on which the pressure Pm acts, F2=Pm×S3 is satisfied. In this case, since the pressure Pc in the crank chamber 140 is equal to the pressure Ps in the suction chamber 141, F1=Ps×S3 is satisfied. That is, F2−F1=(Pm−Ps)×S3 is satisfied.

Hence, in the second control valve 400, when "(Pm−Ps)×S3" exceeds a resistance f2 required for the other end surface 421*b* of the large-diameter portion 421 of the valve body 420 to separate from the extended surface 414, the other end surface 421*b* of the large-diameter portion 421 of the valve body 420 separates from the extended surface 414 and the one end surface 421*a* of the large-diameter portion 421 in the valve body 420 comes into contact with the first end wall surface 411. That is, the second control valve 400 is in a state as shown in FIG. 5A. With this, the second port 432 and the third port 433 are closed, to close the second discharge passage 146*b*.

In other words, when the first control valve 300 opens the supply passage 145, the second discharge passage 146*b* is closed and at this time, the discharge passage 146 contains only the first discharge passage 146*a*. At the same time, the refrigerant in the discharge chamber 142 passes the first control valve 300 and the second control valve 400 and the flow of the refrigerant presses the check valve body 520 of the check valve 500 to open the fifth port 531. As a result, the refrigerant in the discharge chamber 142 is supplied to the crank chamber 140 and the pressure in the crank chamber 140 is increased, so that the stroke volume (discharge volume) of the piston 136 is decreased from the maximum level. Then, the stroke volume of the piston 136 is adjusted so as to maintain the pressure in the suction chamber 141 at the set pressure corresponding to the amount of current supply to the molded coil 314.

In this embodiment, the one end surface 421*a* of the large-diameter portion 421 in the valve body 420 corresponds to a "first end surface of a valve body" of the present invention, and the other end surface 421*b* of the large-diameter portion 421 of the valve body 420 corresponds to a "second end surface of a valve body". The guide shaft portion 415*a* corresponds to a "valve body support portion" of the present invention. The shaft through hole 415*c* formed in the shaft member 415 corresponds to a "pressure introducing portion" of the present invention.

According to this embodiment, for example, the valve body 420 is attached to the guide shaft portion 415*a* and also the cylinder block 101 and the cylinder head 104 are fastened together so that the valve body 420 attached to the guide shaft portion 415*a* is accommodated in the accommodation hole 104*f*, to thereby form the second control valve 400. Here, the guide shaft portion 415*a* can be installed easily and the valve body 420 can be one part. This makes the structure of the second control valve much simpler than the conventional technique, and achieves cost reduction and productivity enhancement of the second control valve.

Moreover, with the guide shaft portion 415*a* being inserted into the receiving portion 423, the valve body 420 is supported movably in the direction perpendicular to the first end wall surface 411 of the valve chamber 410 without contact with the peripheral wall surface 413 of the valve chamber 410. This ensures stable and smooth movement of the valve body 420 in the valve chamber 410.

Here, the receiving portion 423 formed in the valve body 420 is formed as a bottomed hole (guide hole). This prevents a situation in which foreign matter intrudes into a gap between the guide shaft portion 415*a* and the receiving portion 423 from the valve chamber 410 side and hinders the movement of the valve body 420. Moreover, to the bottom portion (closed space) of the receiving portion 423, a pressure in the crank chamber 140 is introduced through the shaft through hole 415*c* formed in the shaft member 415 (guide shaft portion 415*a*). Therefore, the pressure in the crank chamber 140 reliably acts on the bottom surface of the receiving portion 423 as well, and the valve body 420 can move sensitively in response to a difference between the pressure Pc in the crank chamber 140 and the pressure Pm in the valve chamber 410 (i.e., pressure in the region of the supply passage 145 between the first control valve 300 and the check valve 500). Note that a groove may be formed in an outer peripheral surface of the shaft member 415 so as to extend from the distal end surface of the guide shaft portion 415*a* to the distal end surface of the protrusion 415*b* in place of the shaft through hole 415*c*.

Modified examples of the above embodiment will be described below. The respective modified examples yield the same effects as the above embodiment. The following description focuses on a different configuration from the above embodiment, and the same components as the above embodiment are omitted if not necessary.

Modified Example of Supply Passage 145

Figure 10:
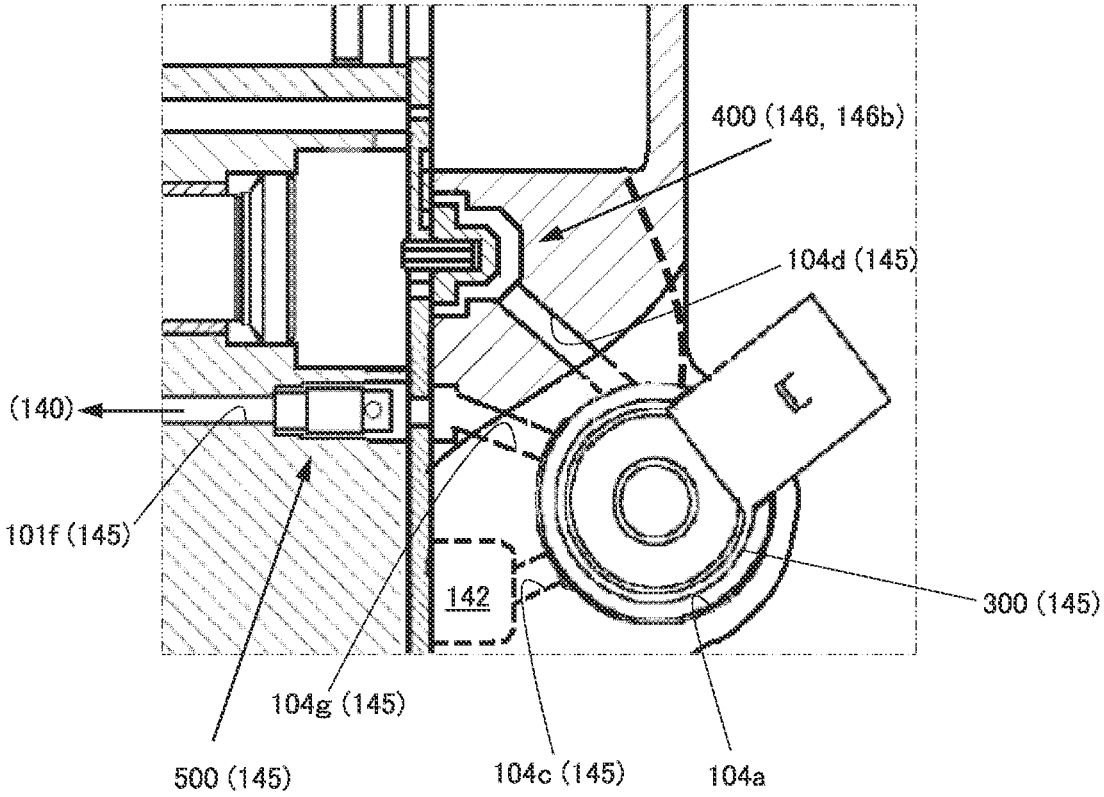
FIG. 10 shows a modified example of the supply passage.

In the above embodiment, the supply passage 145 passes the second control valve 400 and a part of the second control valve 400 (first port 431, valve chamber 410, and fourth port 434) constitutes a part of the supply passage 145 (see FIG. 5A). However, the present invention is not limited thereto. The supply passage 145 may not pass the second control valve 400. For example, as shown in FIG. 10, an eighth communication passage 104*g* may be provided in place of the sixth communication passage 104*e* (needless to say, the fourth port 434 of the second control valve 400 is also omitted). The eighth communication passage 104*g* has one end connected to the fifth port 531 of the check valve 500 and has the other end open to the third region SR3 in the accommodation hole 104*a* that accommodates the first control valve 300, similar to the other end of the fifth communication passage 104*d*.

In this case, the supply passage 145 is defined by a passage including the fourth communication passage 104*c*, the second region SR2, the first control valve 300 (second communication hole 301*b*, valve chamber 303, valve hole 301*c*, first pressure sensitive chamber 302, and first communication hole 301*a*), the third region SR3, the eighth communication passage 104*g*, the check valve 500 (fifth port 531, check valve chamber 510 and internal passage 524, and sixth port 532), and the seventh communication passage 101*f*. Moreover, the fifth communication passage 104*d* functions as a pressure introducing passage for introducing the pressure in the region of the supply passage 145 between the first control valve 300 and the check valve 500 into the valve chamber 410 of the second control valve 400.

Modified Example 1 of Second Control Valve 400

Figure 11:
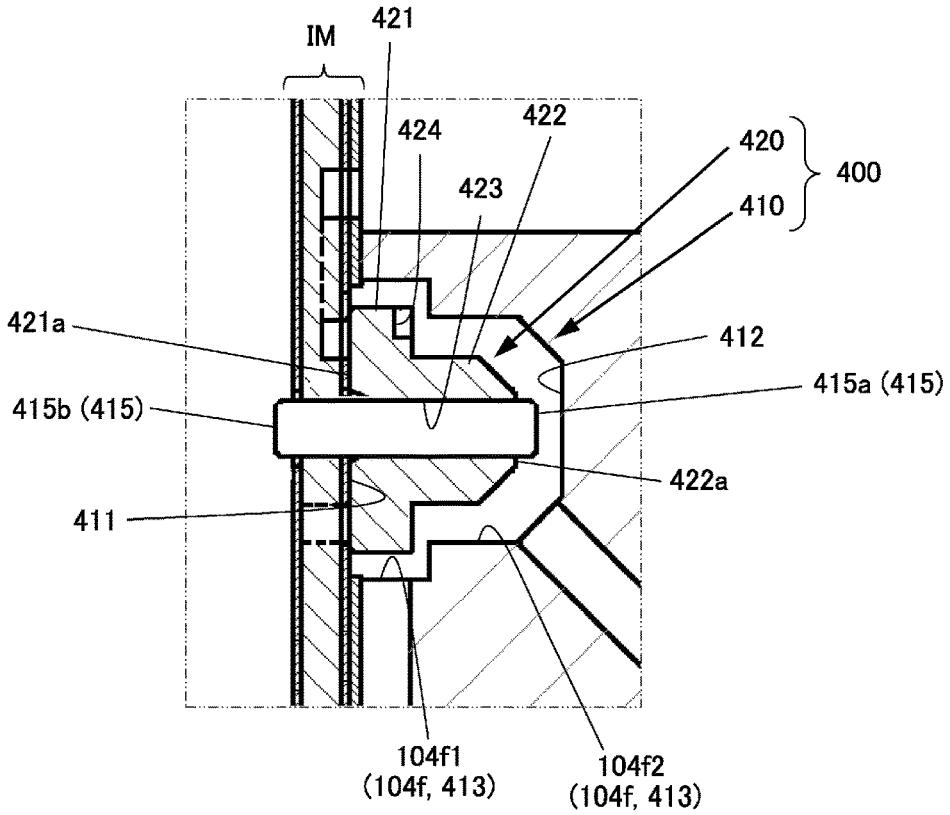
FIG. 11 shows Modified Example 1 of the second control valve.

In the second control valve 400 of the above embodiment, the receiving portion 423 which is formed in the valve body 420 and to which the guide shaft portion 415*a* is slidably inserted, is formed as the bottomed guide hole. However, the present invention is not limited thereto. As shown in FIG. 11, the receiving portion 423 may be formed as a guide through hole that passes through the valve body 420 from the one end surface 421*a* of the large-diameter portion 421 to the distal end surface 422*a* of the small-diameter portion 422. In this case, the shaft through hole 415*c* is not formed in the shaft member 415.

Modified Example 2 of Second Control Valve 400

Figure 12:
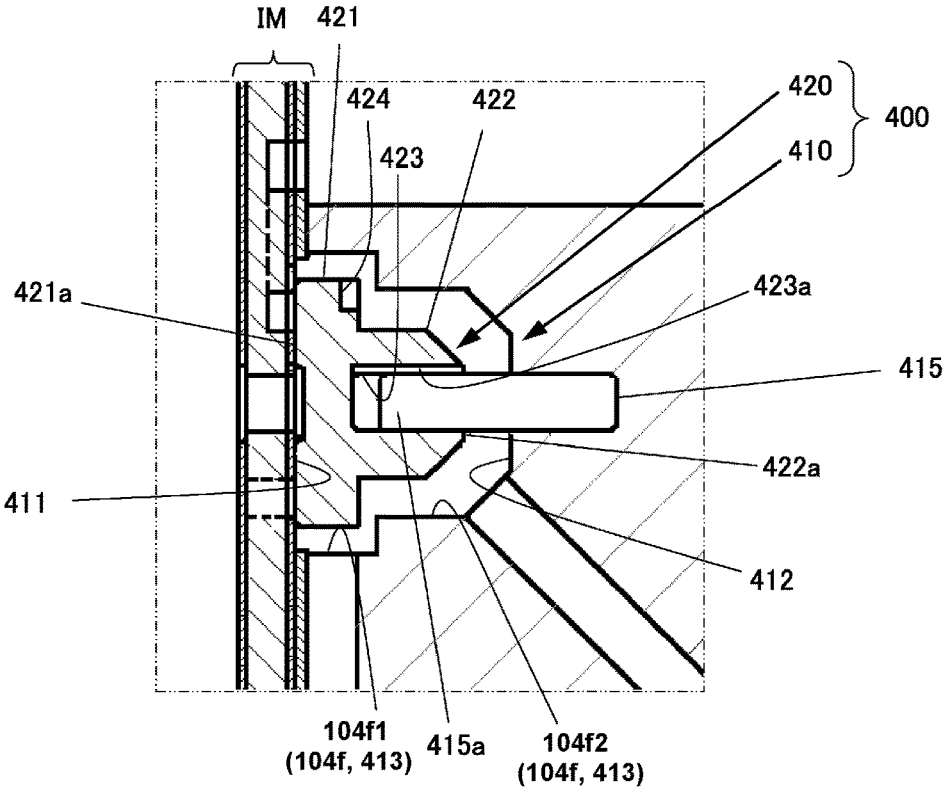
FIG. 12 shows Modified Example 2 of the second control valve.

In the above embodiment, the shaft member 415 is fixed to the intervening member IM and the guide shaft portion 415*a* protrudes from the first end wall surface 411 toward the second end wall surface 412 in the valve chamber 410. However, the present invention is not limited thereto. As shown in FIG. 12, the shaft member 415 may be fitted and fixed into a fitting hole formed in the bottom surface of the accommodation hole 104*f* and the guide shaft portion 415*a* may protrude from the second end wall surface 412 toward the first end wall surface 411 in the valve chamber 410. In this case, the receiving portion 423 to which the guide shaft portion 415*a* is slidably inserted, is open at the center of the distal end surface 422*a* of the small-diameter portion 422 of the valve body 420 and also is formed as a columnar bottomed hole that extends along the center line of the valve body 420. Moreover, in the inner peripheral surface of the receiving portion 423, at least one communication groove 423*a* is formed, which allows communication between the bottom portion (closed space) of the receiving portion 423 and the valve chamber 410. At least one communication groove (not shown) may be formed in an outer peripheral surface of the guide shaft portion 415*a* in place or, or in addition to, the at least one communication groove 423*a*.

Note that in Modified Example 2 of the second control valve 400, the at least one communication groove 423*a* formed in the inner peripheral surface of the receiving portion 423 and/or the at least one communication groove formed in the outer peripheral surface of the guide shaft portion 415*a* correspond to a "communication portion" of the present invention.

Modified Example 3 of Second Control Valve 400

Figure 13:
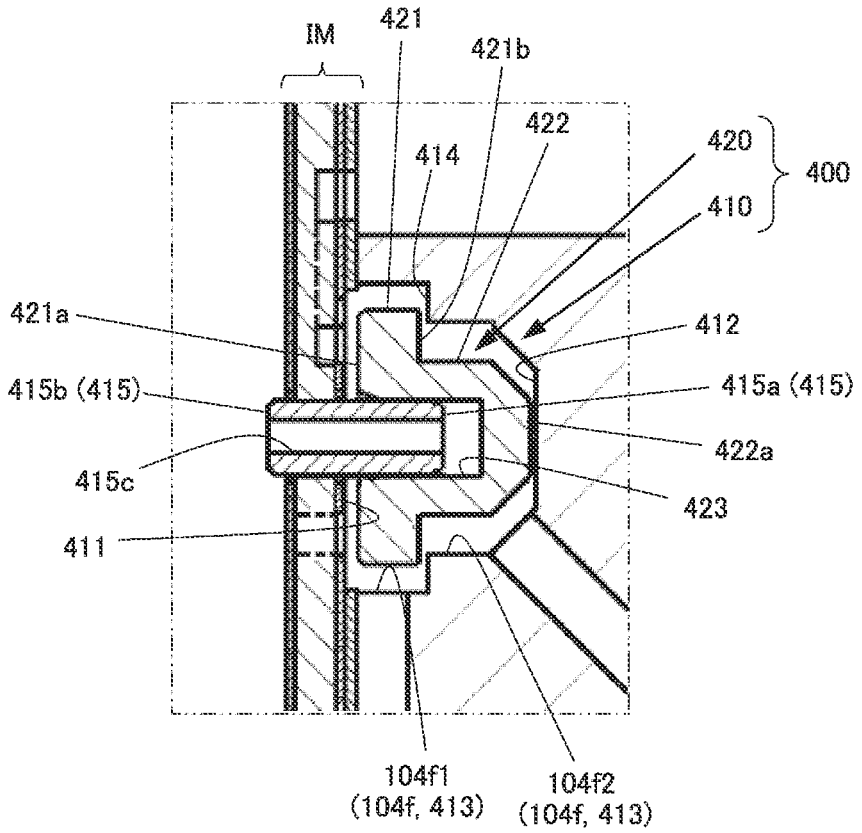
FIG. 13 shows Modified Example 3 of the second control valve.

In the above embodiment, the valve body 420 is restricted from moving in the other direction by the other end surface 421*b* of the large-diameter portion 421 coming into contact with the extended surface 414 of the valve chamber 410. However, the present invention is not limited thereto. As shown in FIG. 13, the valve body 420 may be restricted from moving in the other direction by the distal end surface 422*a* of the small-diameter portion 422 coming into contact with the second end wall surface 412 of the valve chamber 410. In this case, when the distal end surface 422*a* of the small-diameter portion 422 of the valve body 420 comes into contact with the second end wall surface 412, a gap between the other end surface 421*b* of the large-diameter portion 421 of the valve body 420 and the extended surface 414 is at minimum (minute space). Moreover, the notched groove 424 is not formed in the other end surface 421*b* of the large-diameter portion 421 of the valve body 420. Note that in Modified Example 3 of the second control valve 400, the distal end surface 422*a* of the small-diameter portion 422 of the valve body 420 corresponds to a "second end surface of a valve body" of the present invention, and the other end surface 421*b* of the large-diameter portion 421 of the valve body 420 corresponds to an "opposite surface of a valve body" of the present invention.

Here, a spring pin may be used as the shaft member 415 of the above embodiment, the shaft member 415 in Modified Example 2 of the second control valve 400, and the shaft member 415 in Modified Example 3 of the second control valve 400. In this case, it is unnecessary to, for example, form the shaft through hole 415*c* or any groove in the shaft member 415 and to form the communication groove in the outer peripheral surface of the guide shaft portion 415*a*. This is convenient and contributable to cost reduction.

Modified Example 4 of Second Control Valve 400

Figure 14:
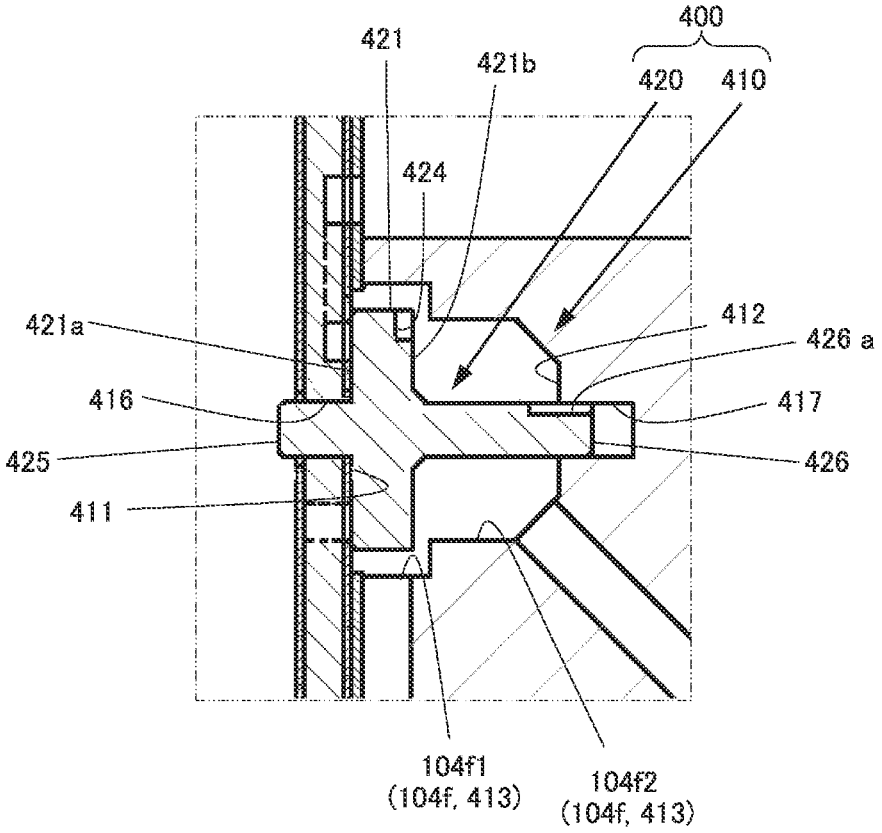
FIG. 14 shows Modified Example 4 of the second control valve.

As shown in FIG. 14, in place of the small-diameter portion 422 and the receiving portion 423, the valve body 420 may have a first shaft portion 425 that protrudes from the center of the one end surface 421*a* of the large-diameter portion 421 and a second shaft portion 426 that protrudes from the center of the other end surface 421*b* of the large-diameter portion 421. In addition, instead of fixing the shaft member 415 to the intervening member IM (first end wall surface 411 of the valve chamber 410), a first support portion 416 that supports the first shaft portion 425 slidably may be formed at the intervening member IM and a second support portion 417 that supports the second shaft portion 426 slidably may be formed at the bottom surface of the accommodation hole 104*f* (second end wall surface 412 of the valve chamber 410). In this case, the first support portion 416 is formed as a through hole that passes through the intervening member IM and the second support portion 417 is formed as a bottomed hole. Moreover, in the outer peripheral surface of the second shaft portion 426, at least one communication groove 426*a* is formed, which allows communication between the valve chamber 410 and the bottom surface side (closed space) of the second support portion 417 formed as the bottomed hole. In place of, or in addition to the at least one communication groove 426*a*, at least one communication groove (not shown) may be formed in the inner peripheral surface of the second support portion 417. Note that in this modified example, the at least one communication groove 426*a* formed in the outer peripheral surface of the second shaft portion 426 and/or the at least one communication groove formed in the inner peripheral surface of the second support portion 417 correspond to the "communication portion" of the present invention.

Modified Example of First Discharge Passage 146*a*

Figure 15:
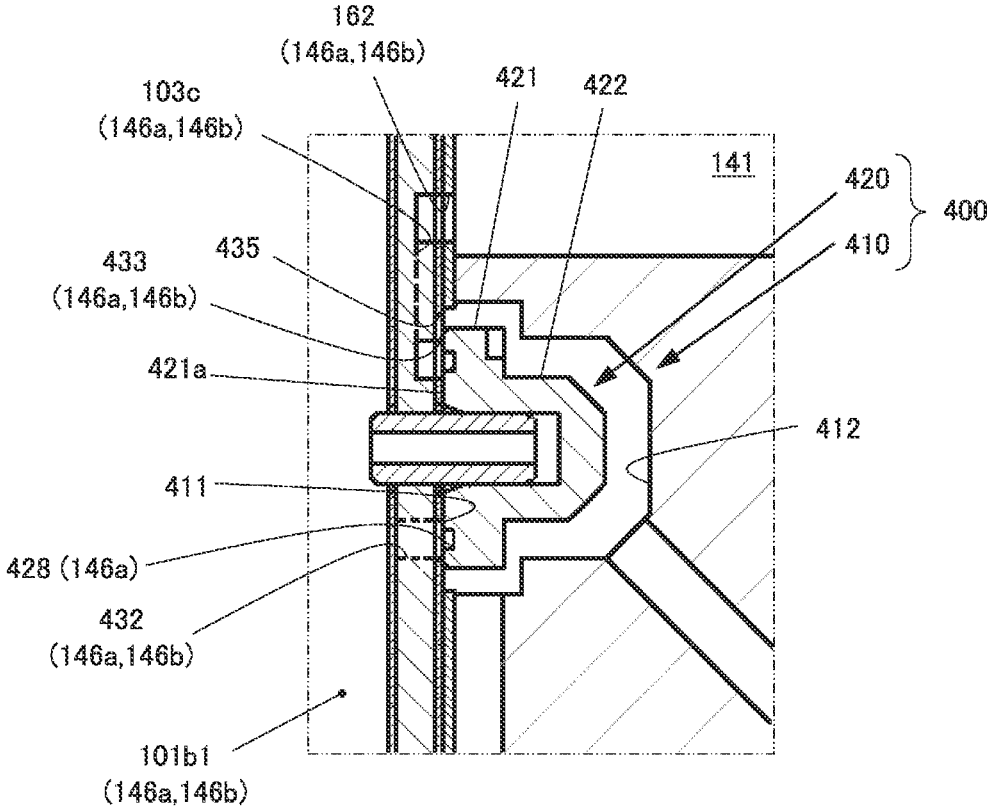
FIG. 15 shows a modified example of the first discharge passage.

In the above embodiment, the first discharge passage 146*a* contains the first communication passage 101*d* that is formed in the cylinder block 101 and the throttle hole 161 that passes through the intervening member IM. However, the present invention is not limited thereto. As shown in FIG. 15, in place of the throttle hole 161, an annular groove 428 may be formed in the one end surface 421*a* of the large-diameter portion 421 in the valve body 420. The width and depth of the annular groove 428 are set so that the annular groove 428 functions as a "throttle". The annular groove 428 is provided so that when the one end surface 421*a* of the large-diameter portion 421 comes into contact with the first end wall surface 411 of the valve chamber 410, the annular groove 428 partially overlaps the second port 432 and the third port 433. In this case, the first discharge passage 146*a* contains the first communication passage 101*d*, the second communication passage 101*e*, the large-diameter bore portion 101*b*1 of the center bore 101*b*, the second control valve 400 (second port 432, annular groove 428, and third port 433), the communication groove 103*c*, and the connection hole 162. Note that the second discharge passage 146*b* is the same as in the above embodiment.

The embodiment of the present invention and modified examples thereof have been described so far, but the present invention is not limited to the above embodiment and these modified examples, and the present invention encompasses other modifications or changes based on the technical ideas thereof.

REFERENCE SYMBOL LIST

100 Variable displacement compressor
101 Cylinder block
101*a* Cylinder bore
101*b* Center bore
140 Crankcase (controlled pressure chamber)
141 Suction chamber
142 Discharge chamber
145 Supply passage
146 Discharge passage
146*a* First discharge passage
146*b* Second discharge passage
147 Throttle passage
300 First control valve
400 Second control valve
410 Valve chamber
411 First end wall surface
412 Second end wall surface
413 Peripheral wall surface
414 Extended surface
415 Shaft member
415*a* Guide shaft portion (valve body support portion)
415*c* Shaft through hole (pressure introducing portion)

416 First support portion (valve body support portion)
417 Second support portion (valve body support portion)
420 Valve body
421 Large-diameter portion
421*a* One end surface (first end surface) of large-diameter portion
421*b* Other end surface (second end surface or opposite surface) of large-diameter portion
422 Small-diameter portion
422*a* Distal end surface (second end surface) of small-diameter portion
423 Receiving portion
424 Notched groove
425 First shaft portion
426 Second shaft portion
431 First port
432 Second port
433 Third port
434 Fourth port
IM Intervening member

The invention claimed is:

1. A variable displacement compressor which is configured to vary a discharge volume by supplying a refrigerant in a discharge chamber to a controlled pressure chamber through a supply passage and also discharging a refrigerant in the controlled pressure chamber to a suction chamber through a discharge passage so as to adjust a pressure in the controlled pressure chamber, the variable displacement compressor comprising:

a first control valve configured to adjust an opening degree of the supply passage;

a check valve that is provided in the supply passage at a position closer to the controlled pressure chamber than the first control valve and is configured to block a refrigerant flowing from the controlled pressure chamber toward the first control valve;

a throttle passage configured to discharge a refrigerant in a region of the supply passage between the first control valve and the check valve to the suction chamber; and a second control valve configured to adjust an opening degree of the discharge passage, wherein the second control valve includes:

a valve chamber having a first end wall surface, a second end wall surface that faces the first end wall surface, a peripheral wall surface that extends between the first end wall surface and the second end wall surface, and an extended surface that extends radially inward from an intermediate portion in an extending direction of the peripheral wall surface, in which a first port that communicates with the region is open to the second end wall surface or to a portion of the peripheral wall surface closer to the second end wall surface than the extended surface, and a second port that communicates with the controlled pressure chamber and also constitutes a part of the discharge passage and a third port that communicates with the suction chamber and also constitutes a part of the discharge passage are open to the first end wall surface; and a valve body having a first end surface and a second end surface that opposes the first end surface and being accommodated in the valve chamber so as to move inside the valve chamber based on a differential pressure between the region and the controlled pressure chamber, wherein when the first control valve opens the supply passage and then a pressure in the region becomes higher than a pressure in the controlled pressure chamber, the first end surface of the valve body comes into contact with the first end wall surface of the valve chamber, to close the second port and the third port, with which the discharge passage is adjusted to a minimum opening degree, whereas when the first control valve closes the supply passage and then the pressure in the region becomes lower than the pressure in the controlled pressure chamber, the first end surface of the valve body separates from the first end wall surface of the valve chamber, to open the second port and the third port, with which the discharge passage is adjusted to a maximum opening degree and also the second end surface of the valve body comes into contact with the extended surface of the valve chamber, to partition the inside of the valve chamber into a first space to which the first port is open and a second space to which the second port and the third port are open, or the second end surface of the valve body comes into contact with the second end wall surface of the valve chamber, to minimize a gap between the extended surface and an opposite surface of the valve body that faces the extended surface, and wherein the valve chamber includes a valve body support portion that supports a radially center portion of the valve body so that the valve body is movable in a direction perpendicular to the first end wall surface without contact with the peripheral wall surface.

2. The variable displacement compressor according to claim 1, wherein the first end surface of the valve body has a second communication portion that allows communication between the second port and the third port when the first end surface of the valve body comes into contact with the first end wall surface of the valve chamber, and wherein when the second port and the third port communicate with each other through the second communication portion, the discharge passage is adjusted to a minimum opening degree.

3. The variable displacement compressor according to claim 1, wherein the second control valve is provided in the supply passage between the first control valve and the check valve, and in the valve chamber, the first port communicates with a portion of the region between the first control valve and the second control valve, and a fourth port that communicates with a portion of the region between the second control valve and the check valve is open to a portion of the peripheral wall surface closer to the first end wall surface than the extended surface, and wherein the second control valve is configured such that when the first end surface of the valve body comes into contact with the first end wall surface of the valve chamber to close the second port and the third port, the first port and the fourth port communicate with each other.

4. The variable displacement compressor according to claim 3, wherein the first end surface of the valve body has a second communication portion that allows communication between the second port and the third port when the first end surface of the valve body comes into contact with the first end wall surface of the valve chamber, and wherein when the second port and the third port communicate with each other through the second communication portion, the discharge passage is adjusted to a minimum opening degree.

5. The variable displacement compressor according to claim 1, wherein the valve body has a first shaft portion that protrudes from a center of the first end surface and a second shaft portion that protrudes from a center of the second end surface, and wherein the valve body support portion is a first support portion and a second support portion, the first support portion being formed at the first end wall surface to support the first shaft portion slidably in an axial direction, and the second portion being formed at the second end wall surface to support the second shaft portion slidably in the axial direction.

6. The variable displacement compressor according to claim 5, wherein the second control valve is provided in the supply passage between the first control valve and the check valve, and in the valve chamber, the first port communicates with a portion of the region between the first control valve and the second control valve, and a fourth port that communicates with a portion of the region between the second control valve and the check valve is open to a portion of the peripheral wall surface closer to the first end wall surface than the extended surface, and wherein the second control valve is configured such that when the first end surface of the valve body comes into contact with the first end wall surface of the valve chamber to close the second port and the third port, the first port and the fourth port communicate with each other.

7. The variable displacement compressor according to claim 5, wherein at least one of the second shaft portion and the second support portion includes a communication portion through which the valve chamber and the inside of the second support portion communicate with each other.

8. The variable displacement compressor according to claim 7, wherein the second control valve is provided in the supply passage between the first control valve and the check valve, and in the valve chamber, the first port communicates with a portion of the region between the first control valve and the second control valve, and a fourth port that communicates with a portion of the region between the second control valve and the check valve is open to a portion of the peripheral wall surface closer to the first end wall surface than the extended surface, and wherein the second control valve is configured such that when the first end surface of the valve body comes into contact with the first end wall surface of the valve chamber to close the second port and the third port, the first port and the fourth port communicate with each other.

9. The variable displacement compressor according to claim 7, wherein the first end surface of the valve body has a second communication portion that allows communication between the second port and the third port when the first end surface of the valve body comes into contact with the first end wall surface of the valve chamber, and wherein when the second port and the third port communicate with each other through the second communication portion, the discharge passage is adjusted to a minimum opening degree.

10. The variable displacement compressor according to claim 1, wherein the valve body support portion is either a guide shaft portion that protrudes from the first end wall surface toward the second end wall surface or a guide shaft portion that protrudes from the second end wall surface toward the first end wall surface, and wherein the valve body is supported movably in the direction perpendicular to the first end wall surface without contact with the peripheral wall surface of the valve chamber, by the guide shaft portion being slidably inserted into a receiving portion that is formed at the radially center portion of the valve body.

11. The variable displacement compressor according to claim 10, further comprising:

a cylinder head including the suction chamber and the discharge chamber;

a cylinder block with a cylinder bore that accommodates a piston; and an intervening member provided between the cylinder block and the cylinder head, with a first through hole and a second through hole, the first through hole allowing communication between the cylinder bore and the suction chamber, and the second through hole allowing communication between the cylinder bore and the discharge chamber, wherein the piston reciprocates to take in a refrigerant from the suction chamber to the cylinder bore and then compress and discharge the refrigerant to the discharge chamber, and wherein the valve chamber is defined by an accommodation hole that is formed in the cylinder head and closed by the intervening member, a portion of the intervening member that closes the accommodation hole constitutes the first end wall surface of the valve chamber, and the valve body support portion is fixed to the portion of the intervening member that closes the accommodation hole.

12. The variable displacement compressor according to claim 10, wherein the second control valve is provided in the supply passage between the first control valve and the check valve, and in the valve chamber, the first port communicates with a portion of the region between the first control valve and the second control valve, and a fourth port that communicates with a portion of the region between the second control valve and the check valve is open to a portion of the peripheral wall surface closer to the first end wall surface than the extended surface, and wherein the second control valve is configured such that when the first end surface of the valve body comes into contact with the first end wall surface of the valve chamber to close the second port and the third port, the first port and the fourth port communicate with each other.

13. The variable displacement compressor according to claim 10, wherein the first end surface of the valve body has a second communication portion that allows communication between the second port and the third port when the first end surface of the valve body comes into contact with the first end wall surface of the valve chamber, and wherein when the second port and the third port communicate with each other through the second communication portion, the discharge passage is adjusted to a minimum opening degree.

14. The variable displacement compressor according to claim 10, wherein the receiving portion is formed as a bottomed guide hole that is open at a center of the first end surface or the second end surface of the valve body and also extends along a center line of the valve body.

15. The variable displacement compressor according to claim 14, wherein the valve body support portion is the guide shaft portion that protrudes from the second end wall surface to the first end wall surface, wherein the receiving portion is formed as the bottomed guide hole that is open at a center of the second end surface of the valve body and also extends along the center line of the valve body, and wherein at least one of the guide shaft portion as the valve body support portion and the guide hole as the receiving portion includes a communication portion through which the valve chamber and a bottom portion of the guide hole as the receiving portion communicate with each other.

16. The variable displacement compressor according to claim 14, wherein the first end surface of the valve body has a second communication portion that allows communication between the second port and the third port when the first end surface of the valve body comes into contact with the first end wall surface of the valve chamber, and wherein when the second port and the third port communicate with each other through the second communication portion, the discharge passage is adjusted to a minimum opening degree.

17. The variable displacement compressor according to claim 14, wherein the valve body support portion is the guide shaft portion that protrudes from the first end wall surface toward the second end wall surface, wherein the receiving portion is formed as the bottomed guide hole that is open at a center of the first end surface of the valve body and also extends along the center line of the valve body, and wherein the guide shaft portion as the valve body support portion includes a pressure introducing portion that introduces a pressure in the controlled pressure chamber to a bottom portion of the guide hole as the receiving portion.

18. The variable displacement compressor according to claim 17, further comprising:

a cylinder head including the suction chamber and the discharge chamber;

a cylinder block with a cylinder bore that accommodates a piston; and an intervening member provided between the cylinder block and the cylinder head, with a first through hole and a second through hole, the first through hole allowing communication between the cylinder bore and the suction chamber, and the second through hole allowing communication between the cylinder bore and the discharge chamber, wherein the piston reciprocates to take in a refrigerant from the suction chamber to the cylinder bore and then compress and discharge the refrigerant to the discharge chamber, and wherein the valve chamber is defined by an accommodation hole that is formed in the cylinder head and closed by the intervening member, a portion of the intervening member that closes the accommodation hole constitutes the first end wall surface of the valve chamber, and the valve body support portion is fixed to the portion of the intervening member that closes the accommodation hole.

19. The variable displacement compressor according to claim 17, wherein the second control valve is provided in the supply passage between the first control valve and the check valve, and in the valve chamber, the first port communicates with a portion of the region between the first control valve and the second control valve, and a fourth port that communicates with a portion of the region between the second control valve and the check valve is open to a portion of the peripheral wall surface closer to the first end wall surface than the extended surface, and wherein the second control valve is configured such that when the first end surface of the valve body comes into contact with the first end wall surface of the valve chamber to close the second port and the third port, the first port and the fourth port communicate with each other.

20. The variable displacement compressor according to claim 17, wherein the first end surface of the valve body has a second communication portion that allows communication between the second port and the third port when the first end surface of the valve body comes into contact with the first end wall surface of the valve chamber, and wherein when the second port and the third port communicate with each other through the second communication portion, the discharge passage is adjusted to a minimum opening degree.

* * * * *